United States Patent [19]

Behrens et al.

[11] Patent Number: 5,029,762

[45] Date of Patent: Jul. 9, 1991

[54] YARN WINDING APPARATUS AND METHOD

[75] Inventors: Reinhard Behrens; Hans-Jochen Busch; Siegmar Gerhartz; Erich Lenk, all of Remscheid; Hermann Westrich, Wuppertal, all of Fed. Rep. of Germany

[73] Assignee: Barmag A.G., Remscheid, Fed. Rep. of Germany

[21] Appl. No.: 454,723

[22] Filed: Dec. 21, 1989

[30] Foreign Application Priority Data

Dec. 22, 1988 [DE] Fed. Rep. of Germany ..... 3843202
Mar. 20, 1989 [DE] Fed. Rep. of Germany ..... 3909106

[51] Int. Cl.[5] ..... B65H 67/048

[52] U.S. Cl. ..... 242/18 A; 242/18 R; 242/18 PW; 242/18 OEW; 242/18.1; 242/125.1

[58] Field of Search ..... 242/18 A, 18 DD, 25 A, 242/18 R

[56] References Cited

U.S. PATENT DOCUMENTS

| | | | |
|---|---|---|---|
| 3,974,973 | 8/1976 | Lenk et al. | 242/41 |
| 4,106,710 | 8/1978 | Schippers et al. | 242/18 R |
| 4,210,293 | 7/1980 | Fromaget | 242/18 A |
| 4,298,171 | 11/1981 | Fluckiger et al. | 242/18 A |
| 4,325,517 | 4/1982 | Schippers et al. | 242/18.1 |
| 4,598,876 | 7/1986 | Schefer | 242/18 A |
| 4,613,090 | 9/1986 | Sugioka | 242/18 A |
| 4,789,112 | 12/1988 | Schippers et al. | 242/178 |
| 4,867,385 | 9/1989 | Lenk | 242/18 A |

FOREIGN PATENT DOCUMENTS

| | | | |
|---|---|---|---|
| 0015410 | 9/1980 | European Pat. Off. . | |
| 2449415 | 10/1974 | Fed. Rep. of Germany . | |
| 2455739 | 8/1976 | Fed. Rep. of Germany . | |
| 2544773 | 4/1977 | Fed. Rep. of Germany . | |
| 3147965 | 7/1982 | Fed. Rep. of Germany . | |
| 3513796 | 12/1985 | Fed. Rep. of Germany . | |
| 64148 | 5/1979 | Japan | 242/18 A |

*Primary Examiner*—Stanley N. Gilreath
*Attorney, Agent, or Firm*—Bell, Seltzer, Park & Gibson

[57] ABSTRACT

A winding apparatus is disclosed which includes a rotatable revolver having a pair of spindles mounted thereon, with the spindles being adapted to coaxially mount one or more bobbin tubes. Upon rotation of the revolver, the spindles are moved between a winding position and a doffing position, and a traversing mechanism is provided for traversing an advancing yarn and so as to form a cross wound package on the tubes at the winding position. Also, a contact roll is mounted between the traversing mechanism and the winding position so as to be adapted to rest upon the surface of the package being formed. The contact roll is movable a limited distance radially away from the package being wound, and its position is sensed. To accommodate the build of the package, the revolver is positively rotated in response to the sensed position of the contact roll and so that the distance between the axes of the contact roll and the operating spindle is increased and the pressure between the contact roll and the package may be maintained within a small range of variation.

27 Claims, 13 Drawing Sheets

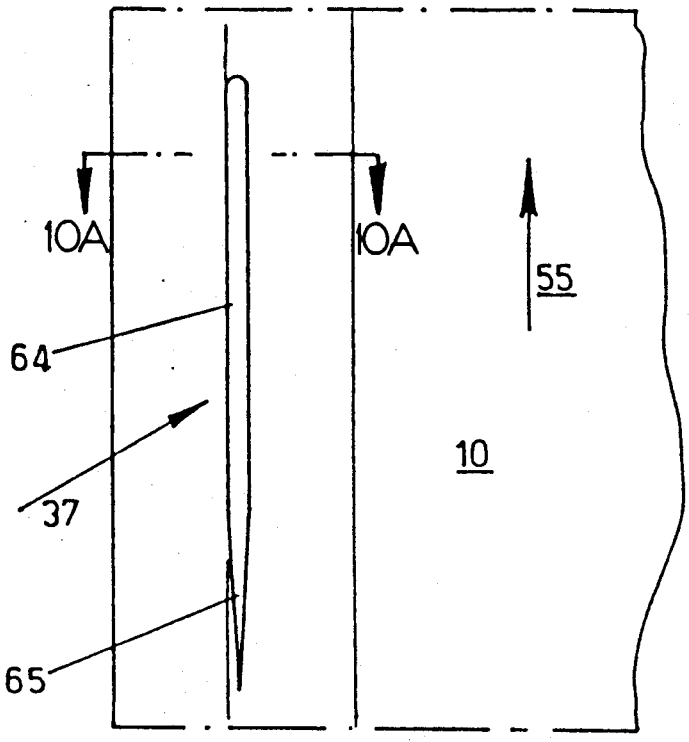
FIG.10.
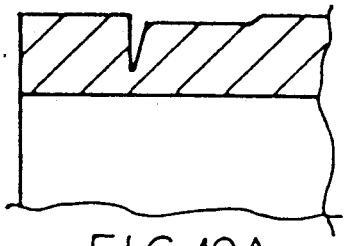
FIG.10A.
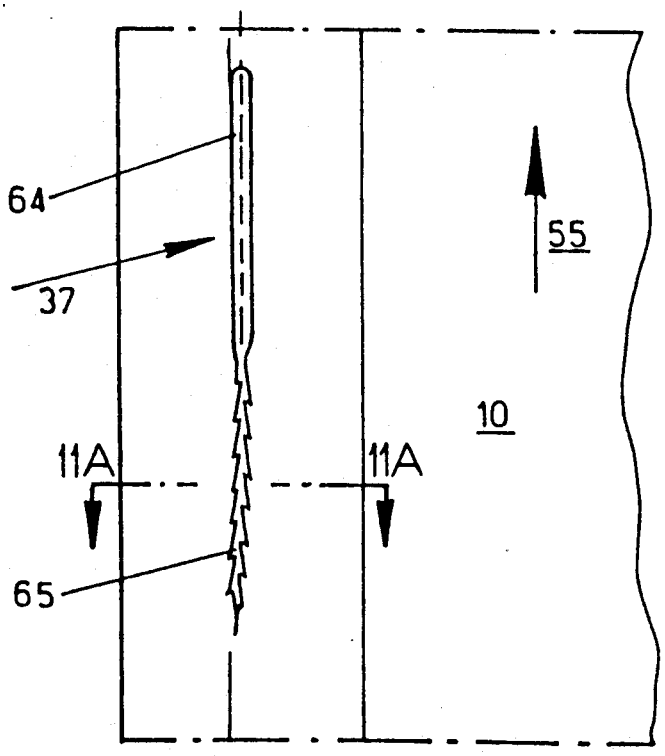
FIG.11
FIG.11A.
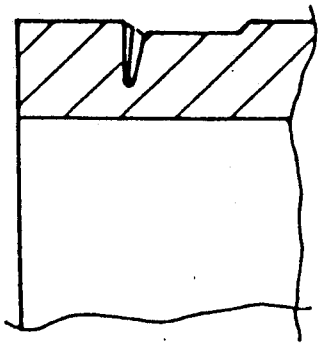

YARN WINDING APPARATUS AND METHOD

BACKGROUND OF THE INVENTION

The present invention relates to a yarn winding apparatus of the type having a rotatable turret or revolver which mounts a pair of winding spindles, and wherein the spindles are serially delivered to a winding position and a doffing position as the revolver is sequentially rotated.

Winding machines of the above described type commonly employ a contact roll which is positioned to rest upon the package being formed on the spindle at the winding position. Also, designs are known wherein the revolver is rotated to provide relative movement between the contact roll and the winding spindle as the package diameter builds, note EP-B1 1359, U.S. Pat. No. 4,298,171 and EP-B 15410.

In such known winding machines, the contact roll is rigidly supported by the machine frame. The winding spindles are mounted on rocking arms, which are pivotally supported on the revolver, so that the winding spindles can occupy an outer and inner radial position relative to the revolver. At the beginning of a winding operation the relative movement between the winding spindle and contact roll, with the revolver at a standstill, is effected by pivoting the rocking arm. Subsequently, the rocking arm is secured relative to the revolver, and the relative movement between the winding spindle and the contact roll is effected by rotating the revolver. To this end, a torque is exerted on the revolver by means of pneumatic and hydraulic cylinders. This torque is counteracted by the torque of the force which is exerted by the stationary contact roll on the package or respectively the winding spindle. The increase of this force causes the revolver to rotate as the package diameter increases.

In the course of a winding cycle, unsteady changes of the radial force which exists between the contact roll and the package to be formed, occur on the winding machine. These result from the fact that the contact pressure is applied by the very same control devices which also control the relative movement between the contact roll and the operating winding spindle. Consequently, the stick-slip effects, which are unavoidable at the slow rotation of the revolver, result in fluctuations, and particularly in unsteady fluctuations, of the contact pressure.

U.S. Pat. No. 4,106,710 discloses a winding machine in which the revolver is stopped during a winding cycle, and thus the winding spindle in operation remains stationary. The contact roll is supported on a slide, which is movable substantially radially to this winding spindle. Consequently, the contact roll can perform a movement relative to the slide. As a function of this movement, pneumatic cylinder-piston assemblies are controlled which serve to compensate for the weight of the slide. Thus, the contact roll does not rest on the package with the weight of all structural parts of the slide, but only with a reduced force. As the package diameter increases, the package must therefore apply the force necessary to move the slide, which corresponds to the aforesaid reduced force.

DE-OS 25 44 773 discloses a winding machine in which the winding spindle is supported in a movable slide. The contact roll is supported in a likewise movable support. The slide of the winding spindle is held by pneumatic cylinders, which are biased by pressure as a function of the movement of the support of the contact roll, thereby compensating for the weight of the slide with the winding spindle and package. As the package diameter increases, the pressure which is exerted in the cylinders is reduced in such a manner that the slide lowers by its own weight. In so doing, stick-slip effects are likewise not preventable. This winding machine is not suitable for a lossfree winding of two alternately operating winding spindles, since it would need for this purpose in addition a rotatable revolver on which the two winding spindles are supported.

It is the object of the present invention to provide a yarn winding apparatus and method of the described type and wherein the radial contact pressure between the contact roll and the package does not unsteadily fluctuate and changes only little in the course of a winding cycle, and which is constructed in a simple and compact manner.

SUMMARY OF THE PRESENT INVENTION

The above and other objects and advantages of the present invention are achieved in the embodiments illustrated herein by the provision of an apparatus which comprises a revolver rotatably mounting at least two spindles, with each spindle being adapted to mount at least one bobbin tube coaxially thereon, and such that each spindle and associated bobbin tube may be selectively moved between a winding position and a doffing position upon rotation of the revolver. Means are provided for winding an advancing yarn onto a bobbin tube at the winding position, and which includes means for rotating the spindle at the winding position, and traversing means mounted at a location upstream of the winding position for traversing an advancing yarn to form a cross wound package.

The apparatus of the present invention also includes a contact roll, and means mounting the contact roll at a location between the traversing means and the winding position and so as to be in circumferential contact with the package being wound, and with the mounting means permitting limited movement of the contact roll in a radial direction away from the package being wound at the winding position. Sensor means is provided for monitoring the radial movement of the contact roll and providing an output signal in response thereto, and rotary drive means is provided for selectively rotating the revolver to move each spindle between the winding position and the doffing position, and for causing rotation of the revolver in response to the output signal from the sensor means so as to increase the distance between the axis of the contact roll and the axis of the spindle at the winding position as the package builds and so that the positioning of the contact roll remains within a predetermined range during the course of the winding operation.

From the above, it will be apparent that the phrases "winding position" and "operating position" as used herein, should not be interpreted to mean that the positions of the spindles are fixed during the winding operation, since the revolver rotates and thus the spindles move within an operating range as the package builds, and as further described below.

In the preferred embodiment, the rotary drive means acts to rotate the revolver in the same rotational direction as that of the spindles, and the contact roll is positioned so that the advancing yarn loops about the contact roll by an angle of at least about 60° in a first direction and then loops about the package being formed in the opposite direction. Also, a contact plane is defined by the axis of the contact roll and the axis of the revolver, and the spindle at the winding position is located on the side of the contact plane toward which the yarn advancing from the contact roll is directed.

It should be emphasized that in the course of a winding cycle, the position of the contact roll remains substantially unchanged, even when the package diameter increases. This means that the contact roll performs only slight movements radially with respect to the operating spindle, in a range of few millimeters, preferably less than 1 mm. The relative movement necessary to adapt the spacing between the axis of the contact roll and the axis of the operating winding spindle to the increasing package diameter, is effected by the rotation of the revolver during the winding cycle. This rotation is effected by a motor, and the motor is controlled by the sensor, which picks up the movement of the contact roll, in particular the distance covered by the support of the contact roll. As a result, the motor of the revolver is so controlled that the revolver rotates even with a very little movement of the contact roll, to an extent that the winding spindle with an increasing package diameter makes way to the contact roll, whereas the contact roll barely leaves its initial position or returns to same again immediately. Thus, the motor associated with the revolver is actuated as a function of the output signal from the sensor, which picks up the deviation between an actual and a desired value of the position of the contact roll.

The rotary drive can be stepwise actuated. To this end, a certain maximum value of the deviation between the actual and the desired value of the position of the contact roll is input, for example, programmed into the rotational control device. As long as the deviation is smaller than this input maximum value of the deviation, the rotational drive is braked, so that the revolver is unable to change its rotational position. If the actual deviation between the desired and the actual value of the position of the contact roll is greater than the input maximum value, the brake will be released, and the revolver will be rotated at a predetermined speed until the deviation between the desired and the actual value is again less than the input maximum value of the deviation.

In another embodiment, the rotary drive is actuated by the control device and the sensor such that the rotary drive is constantly in operation and rotates the revolver without interruption in such a manner that the deviation between the desired value and the actual value of the position of the contact roll is regulated down to a certain, low value.

The contact roll and its support as well as the operating winding spindle and the revolver with the rotary drive thus form, together with the rotational control device and the sensor, a control loop which acts to keep the position of the contact roll substantially unchanged.

In contrast to known winding machines, in the winding machine of the present invention, the distance between the axes of the contact roll and the operating winding spindle is not determined as a function of the contact pressure existing between the contact roll and the operating spindle, but by a rotary drive, which positively drives the revolver in the meaning of increasing the distance between the axes.

Stick-slip phenomena do not occur during a rotation of the revolver, since the revolver is driven positively, i.e., forcibly. The amount of the contact pressure is determined alone by the force operative on the contact roll. The winding spindles are rigidly supported on the revolver, thus providing for a substantially more stable buildup and a steady course of the contact pressure in contrast to the initially described winding machines.

The winding machine of the present invention is adapted for use in the winding of manmade fibers freshly spun in spinning installations. In the design of the winding machine, the revolver rotates in the same direction as the operating spindle and enables a so-called common rotation yarn catching. In this regard, reference is made to European Application 0 286 893 and its corresponding U.S. application, Ser. No. 175,151, now U.S. Pat. No. 4,867,385.

In the preferred embodiment, the contact pressure first increases. This means, at the beginning of a winding cycle, the yarn is wound at a low contact pressure, thereby preventing damage to the first yarn layers. Furthermore, it is possible to keep the change of the contact pressure small.

Also in the preferred embodiment, the support of the contact roll as well as the center of rotation of the revolver and the turning circle in which the spindle axes are located, are arranged relative to each other such that at the desired maximum diameter ratio, the change of the pressure of the contact roll on the package remains within the desired limits during a winding cycle. The diameter ratio is here understood to be the quotient of the diameter of the winding spindle at the beginning of a winding cycle (empty tube) over the diameter of the winding spindle at the end of a winding cycle (full package). This operating diameter ratio amounts to at least 1:3 in modern winding machines. In any event, the allowed change of the radial contact pressure is less than 50%, with the contact pressure starting at a low value and being allowed to first increase at the most. The radial force exerted by the contact roll on the package will preferably change by no more than about 10% in the course of a winding cycle, and preferably by no more than 5% after the first yarn layers are wound.

The winding machine of the present invention operates in such a manner that as the package diameter increases, the revolver is rotated in the same direction as the operating winding spindle. The winding spindles are driven by axial drive motors, one of such motors being associated to each spindle.

As noted above, the present invention makes it possible to keep the contact pressure constant within a small range, which is insignificant from the viewpoint of the winding technology, between the contact roll and the winding spindle or package, while the latter is wound.

In the winding of manmade fibers, for which the winding machine of the present invention is primarily adapted for use, one can expect that the yarn advances in general from the top to the bottom. Since the contact roll is arranged between a yarn traversing mechanism and the operating winding spindle, both the support and the contact roll are weighted by a component of gravity. The present invention utilizes a pressure relief device which engages the support for the contact roll for the purpose of providing at least a partial compensation for the gravitational force. This permits the radially operative bearing force between the contact roll and the package to be adjusted to a degree allowable from the winding technological viewpoint. For example, a biasing force for a constant force, such as a spring or a pneumatic or hydraulic cylinder-piston assembly, which is biased by a constant pressure, may be used as the pressure relief device.

In the case of technologically difficult winding problems, it will also be possible to control, for example, a hydraulic or pneumatic pressure relief device in accordance with a desired course of the contact pressure during a winding cycle.

If the contact roll is supported such that it does not rest on the package by its gravity, but free thereof, a weighing device, for example, a hydraulic or pneumatic cylinder-piston unit will be provided, which is operative on the support of the contact roll and produces the necessary contact pressure, it being possible to design the weighing device such that is produces a constant contact pressure. However, it is also possible to design the weighing device such that in the course of a winding cycle the contact pressure is controlled in accordance with a certain programmed pattern.

The support which mounts the contact roll is preferably a rocker arm, which is pivotally supported on one end by the machine frame, and the other free end of which holds the contact roll. If the contact roll is to rest on the package by its own weight, the rocker arm will be arranged horizontally or obliquely. If the contact roll is to rest on the package without the influence of its weight, the rocker arm would be arranged substantially vertically.

The rocker arm is preferably supported by means of an elastic connection between the arm and the machine frame. This provides for a wear-resistant suspension, which has the advantage that the pivotal motion of the contact roll is subjected to a force which increases along with the deflecting movement. Consequently, it becomes possible to adjust for the zero setting of the contact roll a position which is stable during the course of the winding cycle, without incurring any regulating problems.

The elastic connection may be in the form of a rubber bushing, which has also the advantage that the rubber bushing not only allows a pivotal motion within the range of slight measuring deflections of the contact roll, but it also allows a movement perpendicular thereto, i.e., on the connecting line between the axis of rotation and the axis of the contact roll. This allows the contact roll to align itself parallel to the axis of the winding spindle both in the pivotal direction and vertically thereto. The fact that the rubber bushing also dampens the movement of the contact roll is an important feature.

The yarn traversing mechanism of the present invention may be a device known from the state of the art, such as in particular a rotary blade traversing system as disclosed in EP AO 114642, a traversing system employing a cross-spiralled roll, as is known from U.S. Pat. No. 3,664,596, a traversing system employing a grooved roll, as is disclosed in U.S. Pat. No. 3,797,767, or other yarn traversing systems. The yarn traversing mechanism may be fixedly mounted to the machine frame. However, and in accordance with a further aspect of the present invention, the yarn traversing mechanism may be movably mounted so as to permit the spacing between the traversing mechanism and the contact roll to be varied during the course of the winding operation, as further described below.

As is known, the yarn looping about the contact roll is deposited on the contact roll in accordance with the law of reciprocation of the traversing mechanism, the stroke reversal being dependent on the spacing between the traversing mechanism and the contact line of the yarn on the contact roll. Any change of this spacing will be incorporated in the law of yarn deposit.

In the preferred embodiment, the support for the traversing mechanism is connected to the support for the contact roll. As a result of this construction, the distance between the traversing mechanism and the contact roll does not change in the course of a winding cycle, despite the slight movement of the contact roll. To this end, it is preferred to likewise mount the traversing mechanism on a rocker arm, which is supported either coaxially with the rocker arm of the contact roll or pivotally on the rocker arm of the contact roll. This arrangement will make it possible to lift the traversing mechanism from the contact roll for servicing, so that both the contact roll and the traversing system are easily accessible. On the other hand, this construction also prevents the traversing mechanism from also performing a movement perpendicular to the yarn path during its relative movement to the contact roll. This is especially important, when a drive mechanism is operative on the support of the traversing system, which allows the spacing between the contact roll and the traversing system to be varied in the course of a winding cycle. Thus, the invention also offers the possibility of varying the traverse stroke during a winding cycle. To this end, the drive mechanism is preferably controlled by a predetermined program. A corresponding programming allows the stroke during a winding cycle to be shortened, in particular at its beginning. In this respect, reference is made to the package formation disclosed in U.S. Pat. No. 4,789,112. Furthermore, it is made possible by a corresponding programming to carry out a stroke modification, such as is disclosed, for example, in U.S. Pat. No. 4,325,517 and DE-OS 37 23 524 A1. Likewise, it is possible to axially and periodically reciprocate the traversing mechanism relative to the contact roll, so as to effect in this manner a displacement of the stroke.

The present invention further solves the problem of doffing the packages, in that a package doff occurs in such a manner that the yarn is wound without interruption. To this end, the revolver is rotated always in the same direction both while a yarn is wound and while a package is doffed.

The method of the "common rotation catching", in which the surface of the empty tube and the yarn move in the same direction at the moment when a yarn is caught, is characterized in that the yarn is subjected to only slight fluctuations in its tension. These slight fluctuations of the yarn tension underlie the reliability of this method, in which preferably winding tubes with a yarn catching slot are used, such as is known from DE-A 39 23 305.

In the "common rotation catching" method, the revolver rotates in the same direction as the operating spindle. This means that the idle winding spindle must move past the contact roll when it is rotated to its operating position. This results in a narrowing of the geometrical design possibilities, which is likewise avoided by designing the pressure relief device for the support of the contact roll so that it can lift the roll from the operating spindle. It should be emphasized that only a small movement of the contact roll is required, for example, 10 mm.

The common rotation catching method requires a yarn guide, which deflects the yarn from the normal plane of the yarn catching slot in the empty tube to a normal plane of the full package (cf., PCT/DE 89/00094). This deflecting yarn guide, which is shaped as a plate, serves together with another protective plate the purpose of protecting the empty tube which is to be put in operation, against the full package which is still rotating. In particular, it may happen that the torn or cut yarn end lifts itself from the rotating full package and damages the layers of yarn being formed on the empty tube. The deflecting yarn guide and the protective plate provide for a complete encapsulation of the full package from the empty tube before the yarn is cut or torn. This feature can be advantageously used in all winding machines of the described type.

As aforesaid, it is advantageous in the common rotation yarn catching method that the contact roll can perform a slight evasive movement so as not to impede the empty tube moving to its operating position. In so doing, use is made of the mobility of the contact roll, which serves within the scope of the present invention to control or regulate the rotary drive of the revolver in the course of a winding cycle as a function of the increasing package diameter. However, this function is ineffective while the first layers of yarn are formed on the empty tube. It is thereby accomplished that the revolver can temporarily remain in its position. During this time, the full packages can be removed from the winding spindle which has been moved to the idle or doffing position. To this end, an automatic package doffer can be especially useful.

The measuring function of the contact roll, by which an increasing package diameter is detected, can be restored after a certain programmed time has elapsed or after the full packages on the winding spindle in the idle position are replaced with empty tubes, in that the contact roll is lowered and put in contact with the operating winding spindle. A special control is, however, unnecessary and the measuring function of the contact roll may be restored, by the fact that, as the package diameter increases, there is again a contact between the package and contact roll, which then results in a measuring deviation of the support of the contact roll.

It is preferred that during the contactless time, the contact roll is driven, preferably at a circumferential speed, which corresponds substantially to the nominal circumferential speed of the package. A suitable drive therefor is disclosed in DE-A 38 34 032.

BRIEF DESCRIPTION OF THE DRAWINGS

Some of the objects and advantages of the present invention having been stated, others will appear as the description proceeds when considered in conjunction with the accompanying schematic drawings, in which

FIGS. 10 and 11 are fragmentary plan views of the end portion of bobbin tubes which are suitable for use with the present invention;

FIGS. 10A and 11A are sectional views taken substantially along the lines 10A—10A and 11A—11A of FIGS. 10 and 11 respectively;

DETAILED DESCRIPTION OF THE PREFERRED EMBODIMENTS

The winding apparatuses, which are illustrated in FIGS. 1-4, 5, 6 and 7 differ from each other only in details. Consequently, the following description refers to all embodiments. Reference will be made to the different details as they arise.

Figure 1:
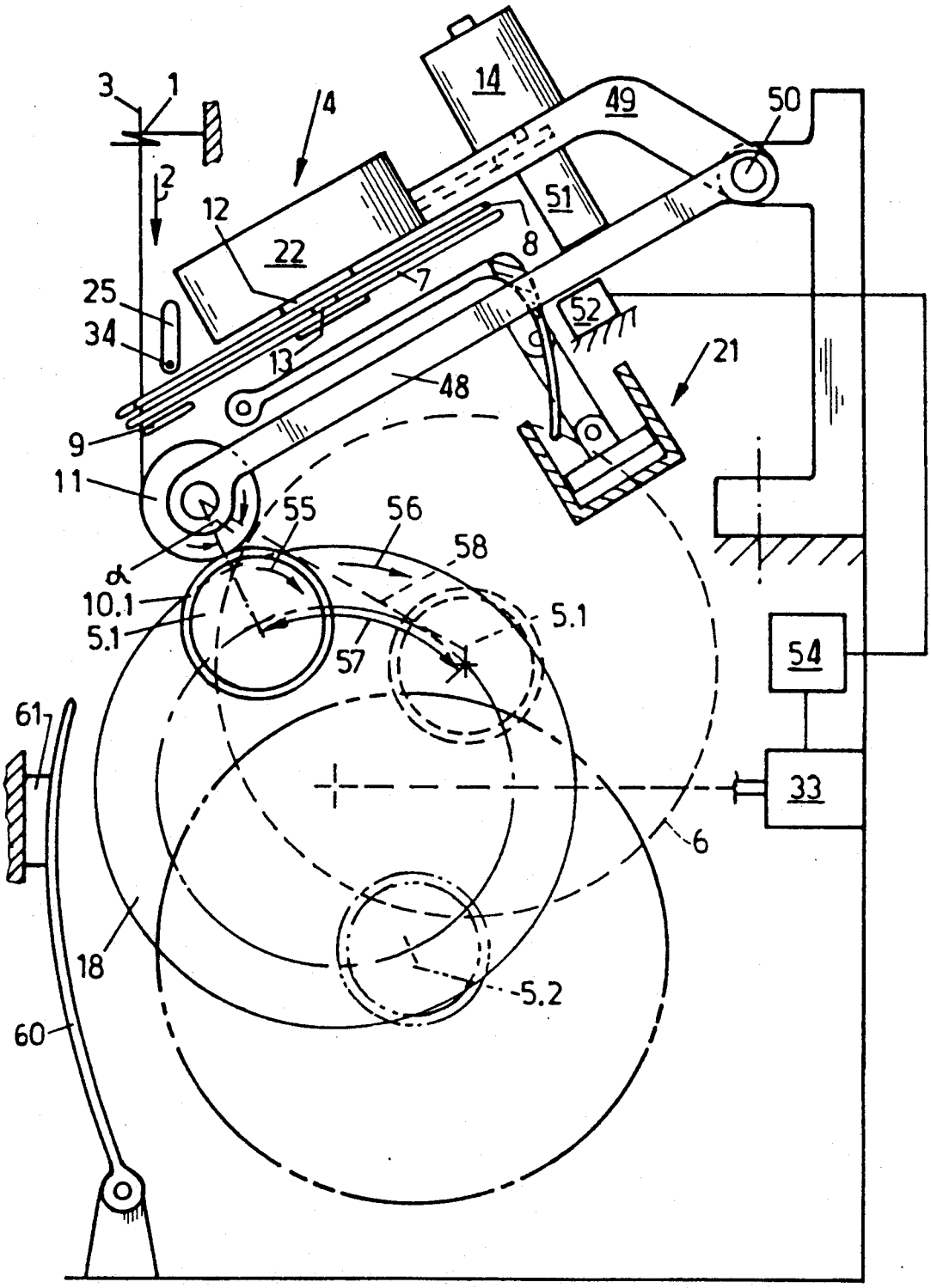
FIG. 1 is a side elevation view of a winding apparatus which embodies the features of the present invention.

The winding apparatus comprises a revolver 18 which is rotatably mounted to the frame of the winding apparatus, and the revolver rotatably mounts two spindles 5.1 and 5.2 which extend along parallel axes. Each spindle is adapted to mount at least one bobbin tube 10.1 and 10.2 respectively. Also, the revolver 18 is rotatable by a drive motor 33 such that each spindle and associated bobbin tube may be selectively moved between a winding position and a idle or doffing position upon rotation of the revolver. In FIG. 1, the spindle 5.1 and tube 10.1 are in the winding position, and the spindle 5.2 is in the doffing position.

A feed system 17 continually advances a yarn 3 at a constant speed to the illustrated winding apparatus. The yarn is first guided through a yarn guide 1 which forms the apex of a traversing triangle. Then, as it moves in direction 2, the yarn reaches a traversing mechanism 4, which is described in more detail below. Downstream of the traversing mechanism, the yarn is deflected about a contact roll 11 by more than 90°, and then it is wound on a package 6. The package 6 is formed on a bobbin tube 10.1, which is placed on the freely rotatable spindle 5.1. The winding spindle 5.1 with the bobbin tube 10.1 placed thereon and the package to be formed on the latter, are shown at the beginning of the winding operating in FIG. 1. At this time, the other winding spindle 5.2 is idle. Both winding spindles 5.1 and 5.2 are freely rotatably supported in the rotatable revolver 18.

In all embodiments, the spindles 5.1 and 5.2 are driven by synchronous motors 29.1 and 29.2, which are each mounted on the revolver 18 in alignment with the spindles. Frequency transmitters 30.1 and 30.2 supply the synchronous motors with a three-phase current of a controllable frequency. The frequency transmitters 30.1 and 30.2 are controlled by a controller 31, which is triggered by a rotary speed sensor 53. The sensor 53 scans the speed of the contact roll and controls, via controller 31, the frequency transmitters 30.1 and 30.2 of the respective operating spindles 5.1 and 5.2 in such a manner that the speed of the contact roll 11 and, thus, also the surface speed of the package remain constant despite the increasing diameter of the latter.

Asynchronous motors may be substituted for the synchronous motors 29.1 and 29.2. In this event, the control frequencies F4 and F5 respectively are superimposed by a control signal, so that the nominal value of the spindle speed, which is respectively input by the controller 31, is exactly maintained. A suitable control system is disclosed in DE-C 34 25 064.

Figure 12:
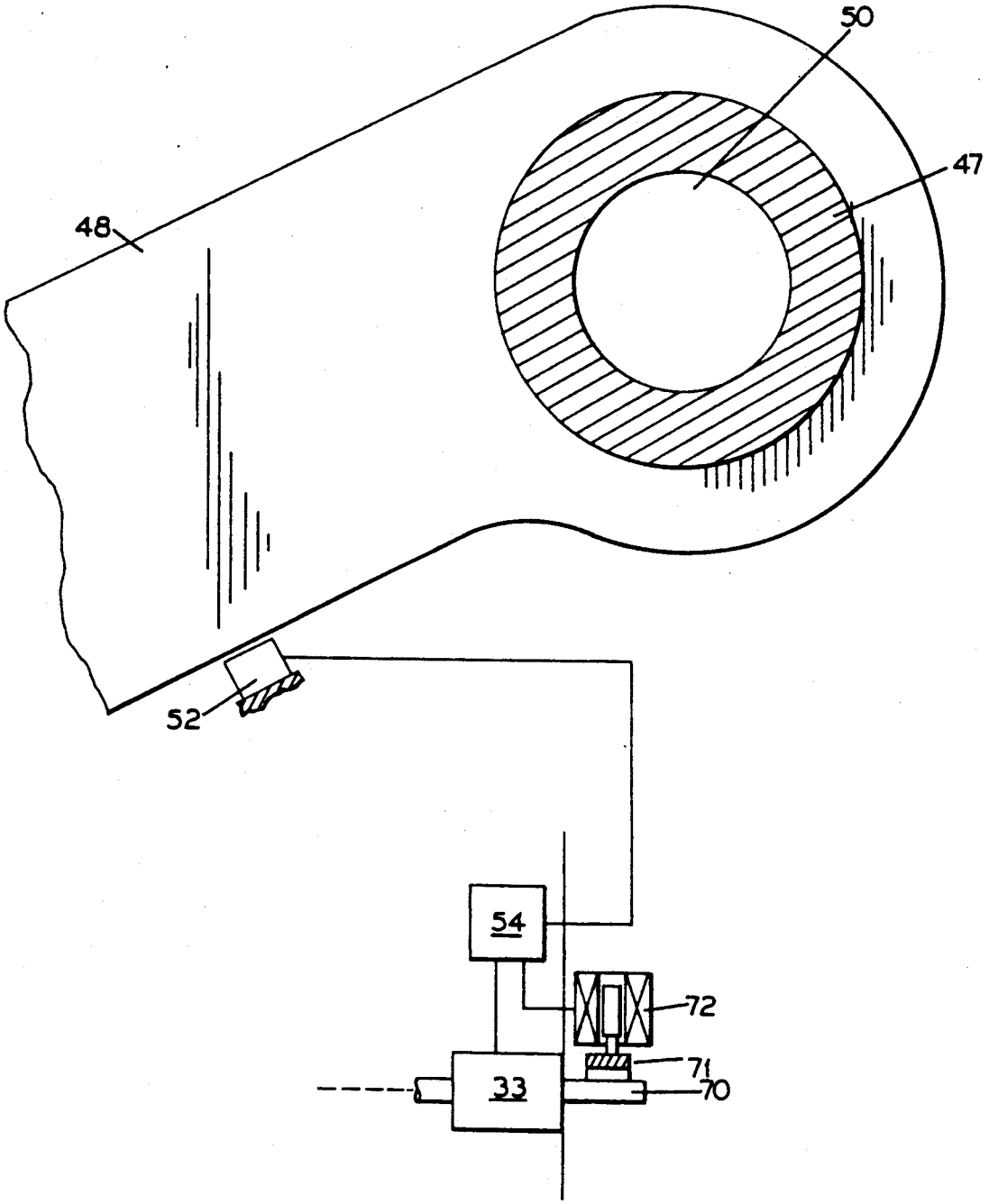
FIG. 12 is a fragmentary sectional view of the mounting arrangement for the contact roll and further illustrating one embodiment for the revolver drive motor.

The revolver drive motor 33 also serves to rotate the revolver 18 in the sense that the distance between axes of the contact roll 11 and the operating spindle 5.1 is enlarged as the package diameter increases. In this regard, the revolver drive motor 33 may also be a braking motor. Such a braking motor has the characteristic that its rotor is immobilized, i.e., it is no longer rotatable, when the braking motor is not connected to a source of current. Such a drive motor 33, which is designed as a braking motor, is schematically illustrated in FIG. 12, which is a detail drawing of FIGS. 1, 4, 5, 6, and 7, and shows the rotary drive and the rotational control means for the revolver 18. A brake 71 is applied to the shaft 70 of the revolver motor 33 and revolver 18. The brake 71 is actuated by an electromagnet 72. The electromagnet is connected with the rotational control device 54, and the rotational control device alternately closes either the rotor circuit of the revolver motor 33 or the circuit of the electromagnet 72 of brake 71 as a function of an output signal of sensor 52, which scans the movement of the support arm 48 (or 63) of the contact roll.

The revolver drive motor may alternatively be a stepping motor, which rotates continually at a very slow speed, and is controlled by the rotational control device as a function of an output signal from the sensor 52, which scans the movement of the support arm 48 (or 63) of the contact roll in such a manner that the distance between the axes of the contact roll 11 and the operating spindle 5.1 is continuously increased as the package diameter increases.

The contact roll 11 is mounted on the support or rocker arm 48, so that it can perform a movement with a radial component to the operating spindle. In the embodiment of FIGS. 1–4, 6 and 7, the rocker arm 48 serves as support for the contact roll. The rocker arm 48 is supported by and pivots about the axis of shaft 50 which is fixed to the frame of the apparatus. The axis of the shaft 50 is arranged in such a manner that the contact roll is movable with a radial component to the operating spindle 5.1, and the rocker arm 48 is supported by a rubber bushing 47. This rubber bushing accommodates the rocking arm 48, so that the latter can pivot in a rubber-elastic manner. An embodiment of such a bearing mount of the rocker arm is shown in detail in FIG. 12, wherein the rubber bushing 47 is a cylindrical tube, which is inserted into the annular space between the shaft 50 and the bearing sleeve at the end of the rocker arm 48. The axis of rotation is thus fixedly supported on the machine frame, and the inner circumference of the rubber bushing is rigidly connected with the surface of the shaft 50. The outer surface of the rubber bushing is fixedly connected with the inner surface of the sleeve of the rocker arm 48.

Figure 5:
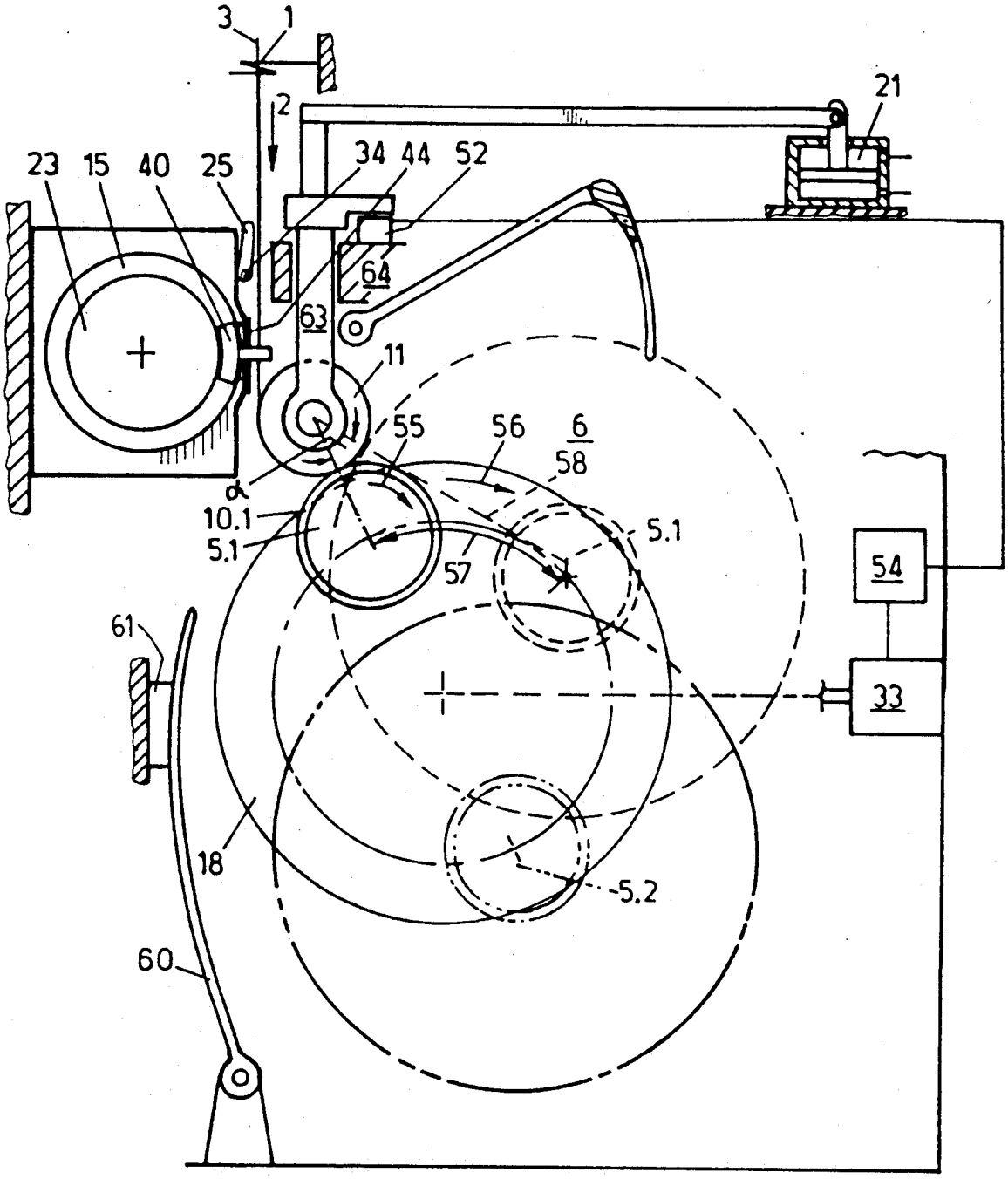
FIGS. 5, 6, and 7 are side elevation views of further embodiments of the present invention.

In the embodiment of FIG. 5, the contact roll 11 is mounted on a support 63, which is linearly movable in a vertical direction in guideways 64. The rocker arm 48, or the support 63, permit the contact roll to give way to the increasing diameter of the package on the spindle at the winding position by a very small distance of, for example, 2 mm.

As noted above, it is possible to use any one of the several known yarn traversing mechanisms with the present invention. In the embodiment of FIGS. 1–4, the traversing mechanism is a so-called rotary blade type traversing system, comprising two rotors 12 and 13, which are interconnected by a gearing 22 and driven by a motor 14. Mounted on the rotors 12 and 13 are rotary blades 7 and 8, as can be seen in particular in FIGS. 2 and 3. The rotors rotate in different directions 27, 28, thereby guiding the yarn along a guide edge 9. In so doing, the one rotary blade assumes the guidance of the yarn in one direction, and moves then below the guide edge, while the other rotary blade takes over the guidance in the other direction and moves then below the guide edge. The motor 14 is driven at a constant speed, but can also be controlled as a function of signals from a programmed controller.

In the embodiment of FIG. 5, the yarn traversing mechanism is of the type employing a cross-spiralled roll 23, which is rotatably supported in a housing and provided in a known manner with an endless reciprocating groove 15 extending over its circumference. One end of a traversing yarn guide 40 engages with this groove 15. The traversing yarn guide is rectilinearly guided in a guide 44 of the housing. Further details of the embodiments relate to the suspension of the traversing mechanism.

Irrespective of the type of traversing mechanism, the housing thereof can be stationarily mounted, as is shown in the embodiment of FIG. 5. In the case of a stationary suspension of the traversing mechanism, the spacing between the contact roll 11 and the traversing yarn guide 40 varies, although the movements of the contact roll are very small and almost negligible.

In the embodiments of FIGS. 1–4, 6 an 7, the yarn traversing mechanism 4 is movably supported on the frame of the winding apparatus. To this end, a rocker arm 49 is employed, the one free end of which mounts the traversing mechanism, whereas its other free end is pivotally supported in such a manner that the traversing mechanism can perform a movement vertical to itself and to the contact roll, i.e., a parallel displacement.

Figure 7:
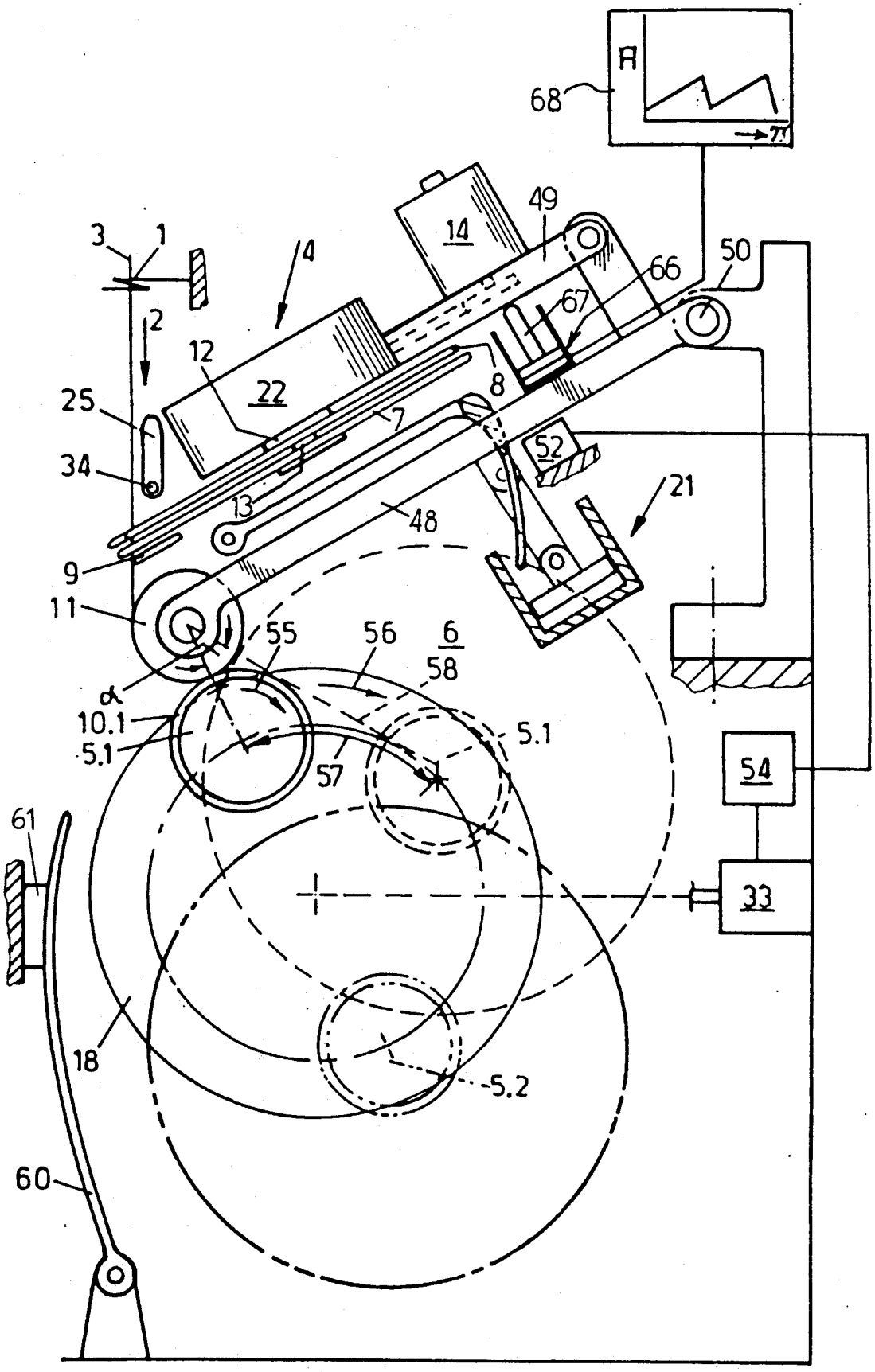

In the embodiments of FIGS. 1–4, the rocker arm 49 is freely rotatably supported on the machine frame, with its axis of rotation being arranged substantially coaxially with the axis of rotation of the shaft 50 of the rocker arm 48. In the embodiment of FIG. 7, the rocker arm 49 supporting the traversing mechanism is rotatably supported on an upright post which is fixed to the rocking arm 48.

In the embodiments of FIGS. 1–4, the rocker arm 49 for the traversing mechanism rests with a support 51 on the rocker arm 48 for the contact roll 11. As a result, the rocker arm 49 follows the movements of the arm 48. However, on the other hand, it can be independently raised, which is of a great advantage for servicing the contact roll and traversing mechanism. A cylinder-piston assembly 21, which is pneumatically biased and operative from the bottom on the rocker arm 48 or support 63 respectively, allows to compensate in part or in whole for the weight, which bears on the contact roll and thus provides a contact pressure on the package. This load is the weight of the traversing mechanism and contact roll (embodiments of FIGS. 1–4, and 7), or only that of the contact roll (embodiments of FIGS. 5 and 6).

A sensor 52 is fixedly arranged on the apparatus frame of all embodiments. This sensor scans the movement of the rocker arm 48 or the support 63 of FIG. 5, in that it measures the spacing to the rocker arm 48 or support 63, i.e., the distance covered by the rocker arm 48 or support 63 respectively. As a function of an output signal, i.e., for example, when a predetermined spacing is exceeded, the sensor 52 emits an output signal, which is supplied to a controller 54 for the revolver drive 33.

The further operation will be described in greater detail below.

The operating method of the winding apparatus is identical for all embodiments, and is, with reference to FIGS. 1–4, as follows. FIG. 1 illustrates the winding spindle 5.1 in the winding position. Only few layers are wound on the empty tube 10.1, and the contact roll 11 contacts the circumference of the package being formed. As the diameter of the package increases, the contact roll performs a slight radial movement. The distance of this movement is detected by the sensor 52. As a function of the output signal of the sensor 52, the motor 33 is triggered by the controller 54 in such a manner that the revolver rotates by a small angle in a direction so that the axial spacing between the contact roll and the operating spindle 5.1 is increased. The rotational direction of the operating spindle 5.1 is indicated by arrow 55. Since the yarn loops anticlockwise about the contact roll, it will loop clockwise about the operating spindle 5.1 and the package being formed. Consequently, the operating spindle also rotates clockwise, and the revolver 18 does likewise in the direction 56.

For the control of the revolver motor the invention provides for two alternative methods. In a first embodiment, the revolver motor 33 is a braking motor, as is shown in FIG. 12, and the shaft of the revolver motor is first locked in position by the brake, so that the revolver can also no longer rotate, as the package diameter increases. As a result, the contact roll 11 is pushed out of its desired position to an actual position. A certain, allowable maximum value for the deviation between the actual position and the desired position of the contact roll is input into the controller 54. As soon as the distance sensor 52 detects that the deviation between the desired position and the actual position exceeds the input maximum value, the brake is released by the magnet, and the rotor of the revolver motor 33 is simultaneously connected with its source of current. As a result, the revolver motor is somewhat further rotated at a slow, but constant speed until the sensor 52 finds that the contact roll 11 has substantially reached again its desired position. The maximum value of the deviation which is allowed between the desired position and the actual position of the contact roll is very small and amounts to, for example, 1 mm. The revolver motor 33 is then again stopped, and the brake is activated. As a result, the shaft the revolver motor 33 and also the revolver are again locked in a non-rotatable position.

In a second embodiment, the revolver motor 33 is constantly connected to a source of current. The very low speed of the revolver motor 33 is controlled by means of the distance sensor 52 and the rotational controlling device 54 in such a manner that the contact roll does not leave its desired position, or that the deviation between the actual and the desired position remains constant and as small as possible. This embodiment requires a revolver motor 33, the rotational speed of which is not dependent on the torque. Consequently, in the case of this revolver motor the pressure between the contact roll 11 and the operating winding spindle 5.1 or respectively the package formed thereon cannot lead to a rotation of the revolver in the first-mentioned embodiment, or respectively to an increase of the rotational speed of the revolver in the last-mentioned embodiment.

Figure 8:
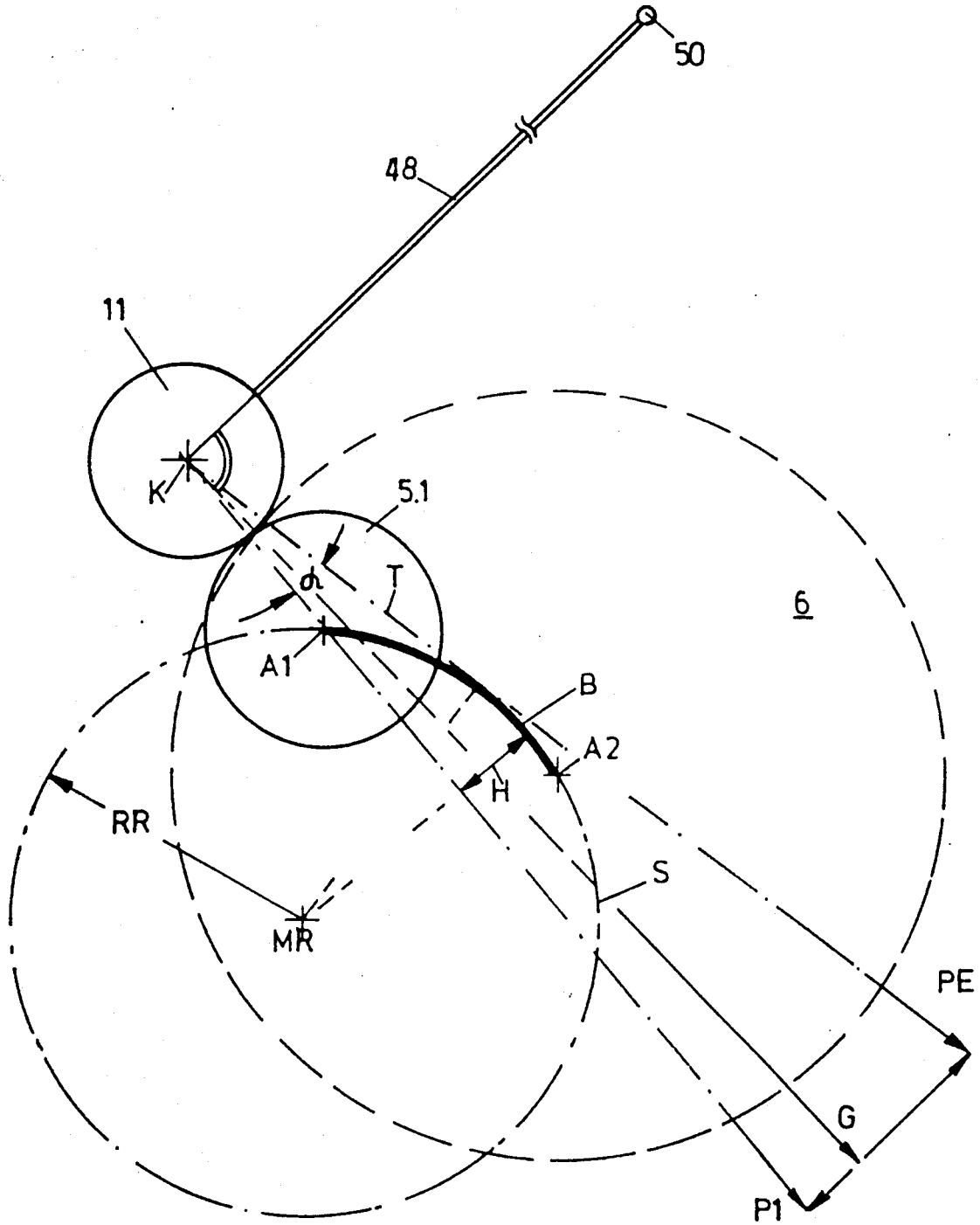
FIGS. 8 and 9 are diagrams showing the course of the contact pressure between the contact roll and the package in accordance with the present invention.
Figure 9:
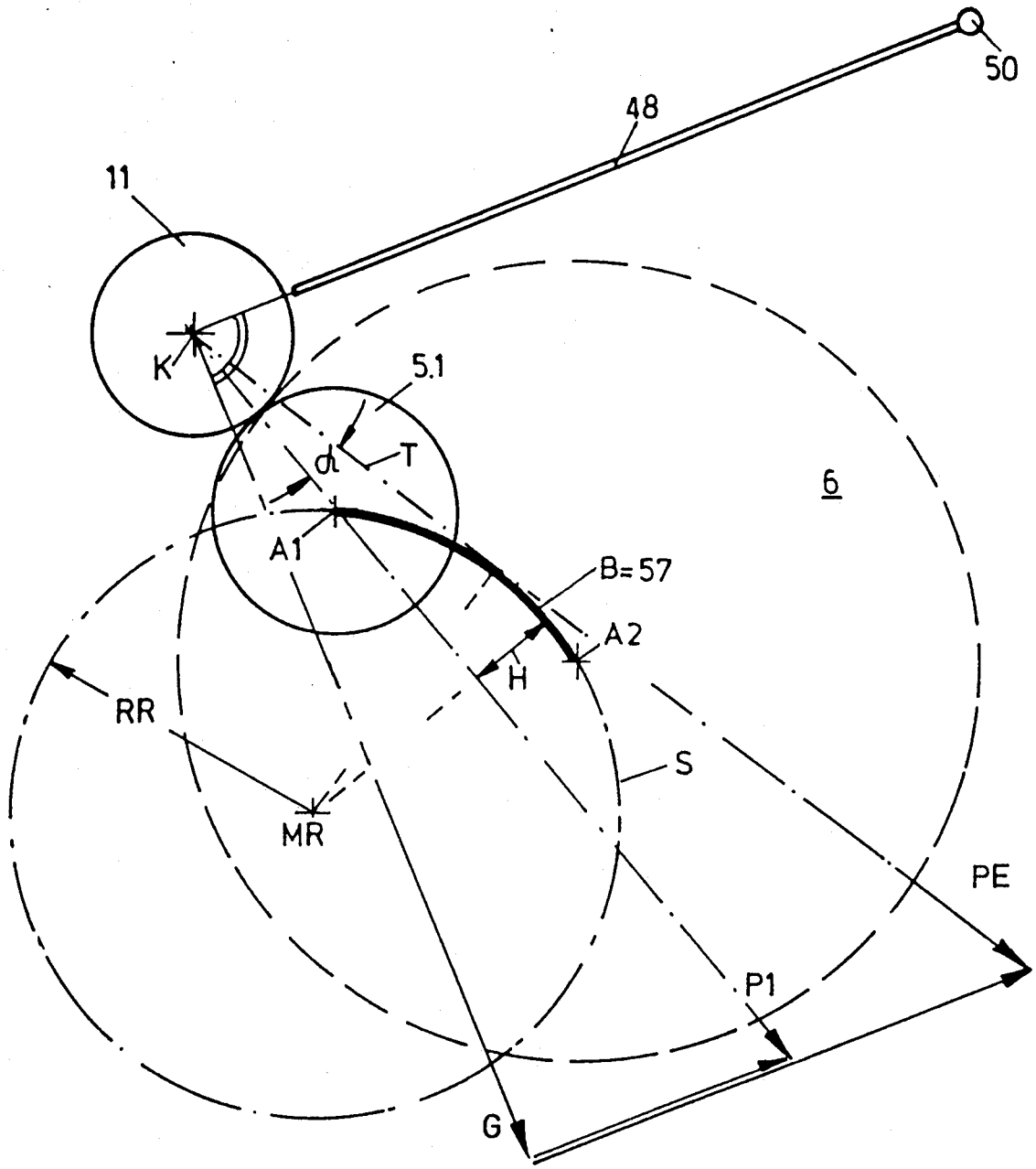

The end position of the package 6 and the operating spindle 5.1 are indicated in dashed lines. It results therefrom that during a winding cycle the axis of the winding spindle travels, as the revolver is rotated, along a portion or the so-called operating range B of the spindle turning circle S (FIGS. 8 and 9). This operating range is indicated at 57 in FIG. 1. The greatest variation of the radial contact pressure occurs between the starting position, in which the operating spindle is put in contact with the roll 11 for the first time, and that position, in which the axis of the operating spindle 5.1 lies on a tangent extending from the center of the contact roll 11 to the operating range of the spindle turning circle. The angle alpha, by which the axis of the winding spindle 5.1 travels relative to the axis of the contact roll 11, should be as small as possible. In FIG. 1 this angle is exaggerated, so as to obtain a better illustration in the drawing. In reality, this angle is substantially smaller, preferably less than 20° and most preferably less than 15°. The special advantage of the invention is that the variation of the contact pressure can be kept small, even at a low diameter ratio (diameter of the empty tube to diameter of the full package) of less than 1:3, and even when the looping angle of the yarn on the contact roll 11 is greater than 90°. Another advantage can be found in that, as is shown in FIG. 1, the looping angle increases rather than decreases on the contact roll as the package diameter becomes larger. A decrease of the looping angle would result in a greater slip of the yarn on the contact roll. An increase of the slip will lead to a change of the yarn tension, in particular, when the contact roll is driven, or driven with an output greater than the idling output, note DE-OS 35 13 796.

A still further advantage is that the contact pressure starts from a relatively low value and increases during a winding cycle and especially at the beginning thereof. This considers the circumstance that the contact pressure should be relatively low when winding the first layers, and increase later.

These advantages result in particular from the fact that, aside from variations, which are insignificant from the viewpoint of the winding technology, the position of the contact roll remains essentially unchanged. Nonetheless, however, the contact pressure is exerted by the mobility of the contact roll and the force being applied thereto, in contrast to the known winding machines, in which the contact pressure is applied by the torque operative on the revolver, and therefore largely dependent on the relative position between the winding spindle and the contact roll.

FIGS. 8 and 9 illustrate again the pertinent features of the present invention with regard to the layout of the winding machine for the purpose of minimizing the fluctuation of the pressure between the contact roll and package. FIGS. 8 and 9 show the cross sectional geometry of the winding machine with the contact roll 11, and winding spindle 5.1 at the beginning of a winding cycle, and the operating range B of the spindle turning circle S, which is described by the revolver with the axes of the winding spindles. During a winding cycle, the axis of the winding spindle moves between the points A1 and A2 on the spindle turning circle S. The section between the points A1 and A2 is here indicated as the operating range B, and at 57 in FIG. 1. Further illustrated, in a different geometric position, is the rocker arm 48, on which the contact roll 11 is rotatably supported, as well as the axis of shaft 50 about which the rocker arm pivots.

The pressure under which the contact roll 11 rests on the package has the direction of the connecting line between the center K of the contact roll 11 and the axis A of the winding spindle 5.1. A first extreme direction extends through the point K and A1, i.e. the position of the axis of the winding spindle at the beginning of a winding cycle. A second extreme direction is the tangent from the axis K to the operating range B of the spindle turning circle S. As can be noted from both FIG. 8 and FIG. 9, the line of application of the force G, which is exerted by the contact roll, is the direction of guidance of the contact roll, i.e., perpendicular to the rocker arm 48 at the point K. At the beginning of a winding cycle, this force G is resolved to a starting contact pressure P1, which extends through the initial position A1 of the spindle axis, and a force parallel to the rocker arm 48. In the extreme case, the force G is again resolved to the parallel force of the rocker arm 48 and the extreme contact pressure PE, which is operative on the tangent T.

As can again be noted from FIGS. 8 and 9, the difference between the initial force P1 and the extreme force PE is relatively small, since the arc, which the initial direction of the force P1 (connecting line between K and A1) cuts off from the spindle turning circle S, has only a small height H. Decisive therefor are the relative position of the center MR of the revolver, the radius RR of the spindle turning circle S as well as the position of the contact roll 11 and the starting position A1 of the winding cycle.

FIG. 8 also shows that the difference between the initial contact pressure P1 and the most extreme contact pressure PE can be further reduced, when the guiding direction of the contact roll 11, which is predetermined by the position of the pivot shaft 50, is so placed that the guiding direction or respectively the direction of force G intersects the operating range B of the spindle turning circle S. In such a particularly favorable geometric layout, the contact pressure slightly decreases at first during a winding cycle until it has precisely the value of the effective force G. Then the contact pressure slightly increases up to the extreme value, and subsequently decreases again. For this reason, this geometric layout is especially preferred.

Figure 4:
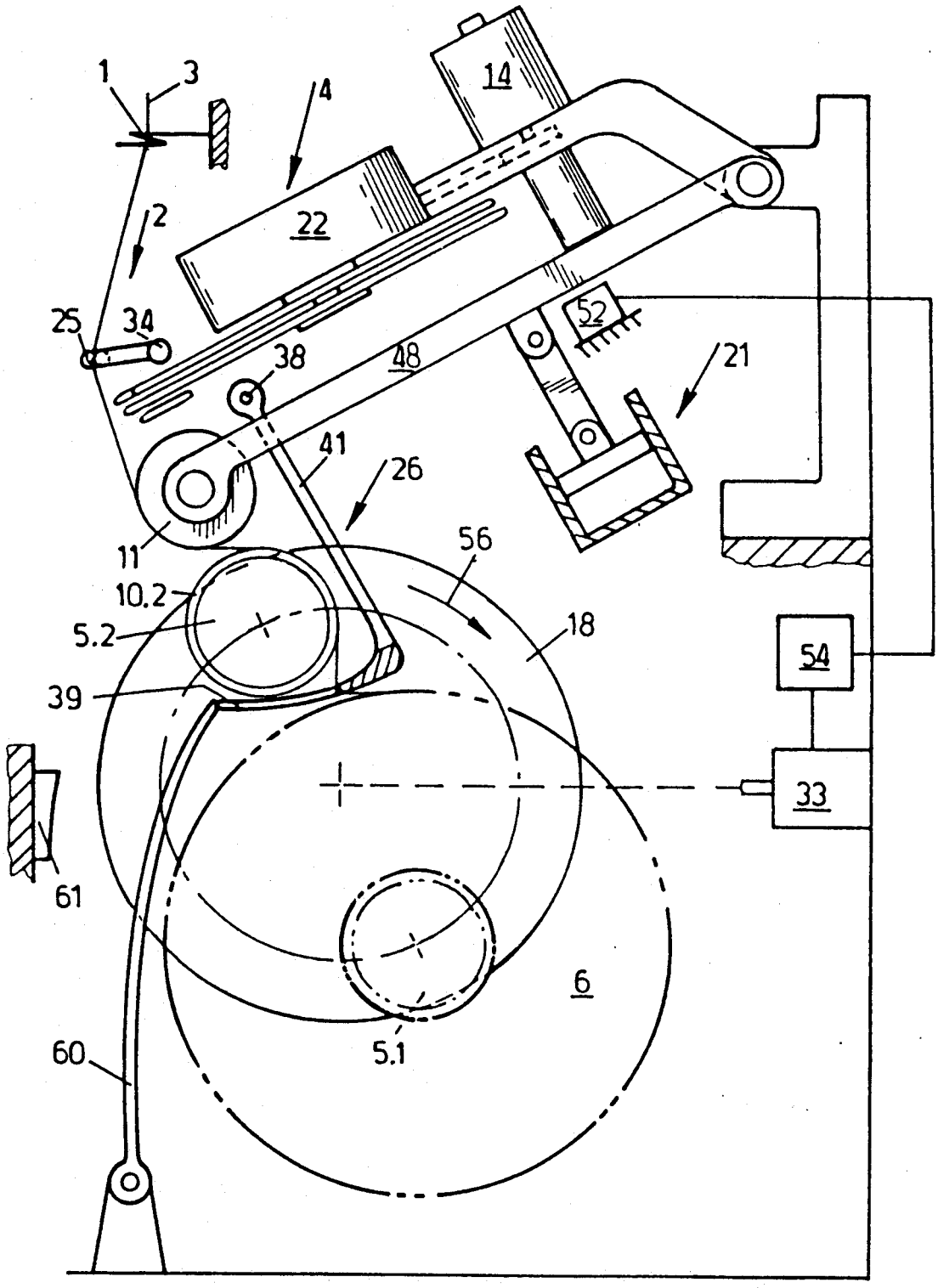
FIG. 4 is a view similar to FIG. 1 and showing the apparatus during a package doff.

As to the method of traversing the yarn, reference is made to the embodiments of FIGS. 1, 4, 5, 6 and 7, which show that the traversing mechanism 4 is movably supported on the rocker arm 49 in such a manner that the spacing between the traversing mechanism and contact roll 11 is variable. In the embodiment of FIGS. 1 and 4, the smallest distance between the traversing mechanism and the contact roll 11, which is maintained during a winding cycle, is predetermined by the stop 51. This means that the spacing is not varied during a winding cycle. However, the distance can be increased, when the winding machine needs to be serviced.

Figure 6:
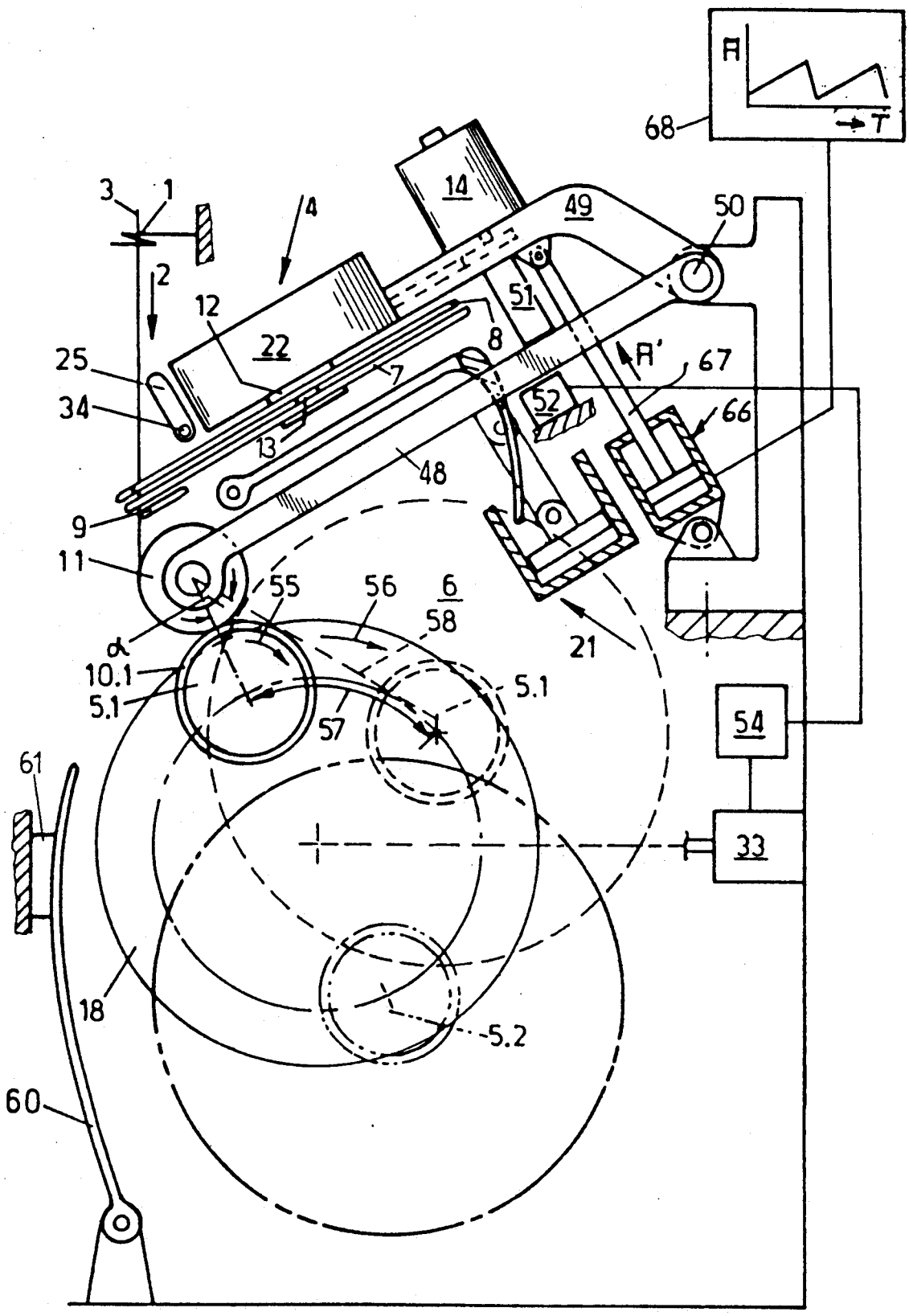

The embodiments of FIGS. 6 and 7 are additionally provided with drive and control devices, which allow the spacing between the traversing mechanism and the contact roll 11 to be varied during a winding cycle. The drive means comprises a pneumatic cylinder-piston assembly 66. The piston and the piston rod 67 of this cylinder-piston assembly are supported on the rocker arm 49. In the embodiment of FIG. 6, the cylinder is supported in the machine frame and in the embodiment of FIG. 7 it is supported on the rocker arm 48 of the contact roll. The control device 68 comprises primarily a programmed controller, which controls the pressure for the drive means 66 according to a predetermined program. In FIGS. 6 and 7, a stroke modification program is input as such a program. In a so-called stroke modification, the traverse stroke is periodically shortened and lengthened, for example by 5%. To this end reference is made to the methods already mentioned hereinabove. The stroke modification serves the purpose of avoiding damage to the package ends, in particular, thickening of the package diameter, as well as faults on the front surfaces of the package. In the conventional method, a stroke modification is effected in that the path of the traversing mechanism is correspondingly shortened or lengthened. However, this is not possible with the illustrated and previously described traversing mechanisms. The present invention creates a method of modifying the stroke, in which the traversing stroke is not varied, and the path of the traversing mechanism remains constant.

In the present invention, the stroke is modified in that according to a predetermined program, the spacing between the traversing mechanism and the contact roll 11 is continuously increased and decreased by the drive means 66. To this end, it will be understood that due to an increase of the spacing between the contact roll and the traversing mechanism, the actual traversing stroke of the yarn decreases on the contact roll and, thus, also on the package. If, however, the spacing between the traversing mechanism and the contact roll is decreased, the actual traverse stroke of the yarn on the contact roll and the package increases.

Figure 13:
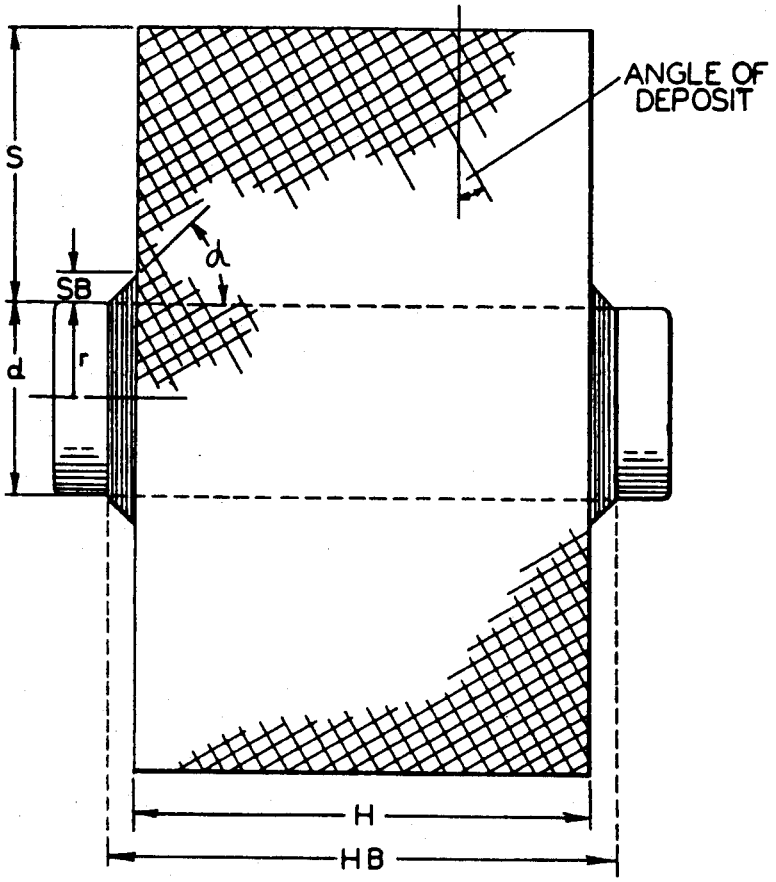
FIG. 13 is a front view of a package which is adapted to be produced by the apparatus of the present invention.
Figure 14:
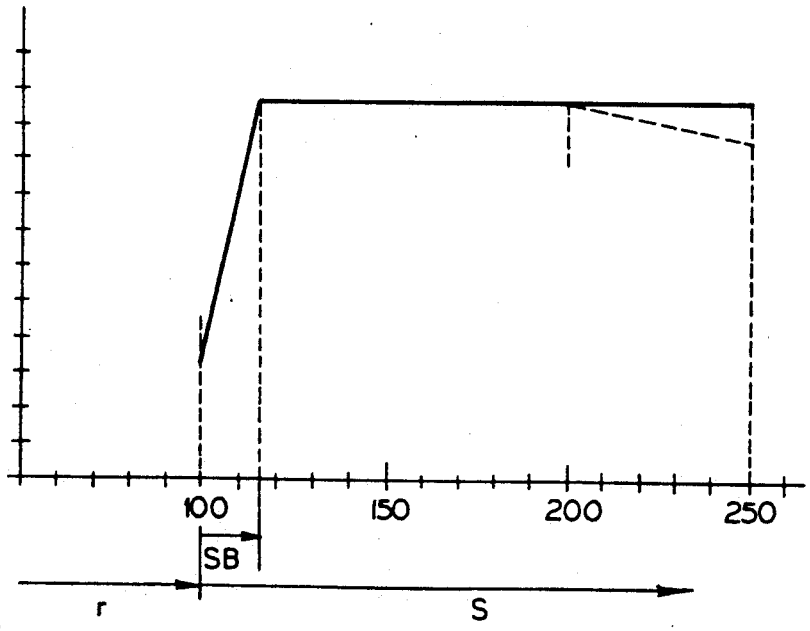
FIG. 14 is a graph illustrating the spacing between the yarn traversing system and the contact roll vs. the package diameter.

As can be seen, other programs also may be input. One of such programs results, for example, from the object of producing a package, as is illustrated in FIG. 13 and disclosed in the above-cited U.S. Pat. No. 4,789,112. According to such a program, the spacing between the traversing mechanism and the contact roll, as is shown in FIG. 14, is increased at the beginning of a winding cycle and then kept constant. In the period of time in which the spacing in increased, a basic layer of no more than 10% of the entire layer thickness of the package is to be achieved. The period of time in which the spacing between the traversing mechanism and the contact roll remains constant, should be adequate so as to build up at least 80% of the entire diameter of the package. Subsequently, the spacing may again be decreased, as indicated by the dashed lines in FIG. 14.

In FIGS. 13 and 14, r is the radius of the empty tube, S the thickness of the layer, SB the thickness of the basic layer, HB is the overall length of the package, and H is the length of the cylindrical portion of the package.

If this program is followed, a package will form which has a slightly conical basic layer on its two front ends, as indicated by the angle alpha in FIG. 13. Otherwise, the package will be cylindrical. The spacing may be varied slightly so that the length variation of the basic layer is barely noticeable and is effective only by an improved, primarily more stable support for all layers of the package.

The method of doffing a package will now be described, which occurs when the operating spindle 5.1 has reached its end position as shown in dashed lines in FIG. 1. To this end, the pressure relief device 21 is biased with pressure in such a manner that it raises the contact roll 11 from the full package. In the illustrated embodiments, the pressure relief device is a pneumatic cylinder-piston assembly 21, which becomes operative on the rocker arm 48 or the support 63 in FIG. 5 of the contact roll. Also here, only a very slight movement of no more than 10 mm is carried out. Now the package revolver is further rotated in direction 56, with the operating spindle 5.1 being further driven. As a result thereof, the spindle 5.2 which has so far been idle, reaches the starting position of the operating range, i.e., the position in which the operating spindle 5.1 is shown in FIG. 1.

It should be added that the drive motor 29.2 of the idle spindle 5.2 has already been started up beforehand, so that the empty tube rotates at the nominal circumferential speed. Referring now to FIG. 4, the empty tube 10.2, which is placed on spindle 5.2, forms in this position a gap with the contact roll 11, through which the yarn advances.

As it enters into its operating position, the spindle 5.2 with the winding tube 10.2 placed thereon is moved into the yarn path extending between the contact roll 11 and the full package 6. In so doing, the empty tube 10.2 moves along the length of contact in the same direction as the yarn. Consequently, the here-described procedure is described as common rotation yarn catching. It should be noted that the yarn is still reciprocated by the traversing mechanism 4 and, consequently, is displaced on the full package 6 over at least the entire traverse stroke H.

Figure 2:
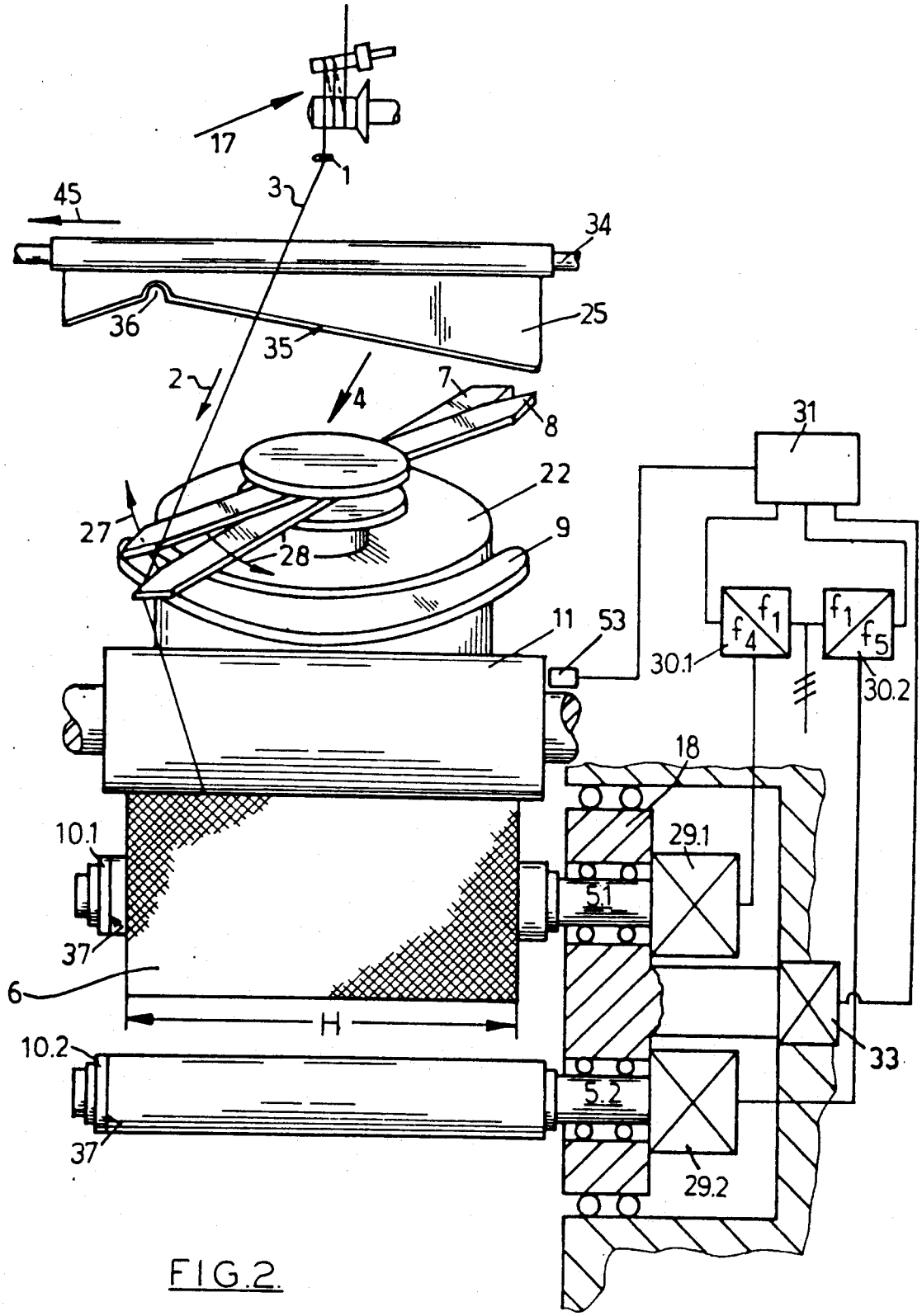
FIG. 2 is a front elevation view of the apparatus shown in FIG. 1.
Figures 3A, 3B:
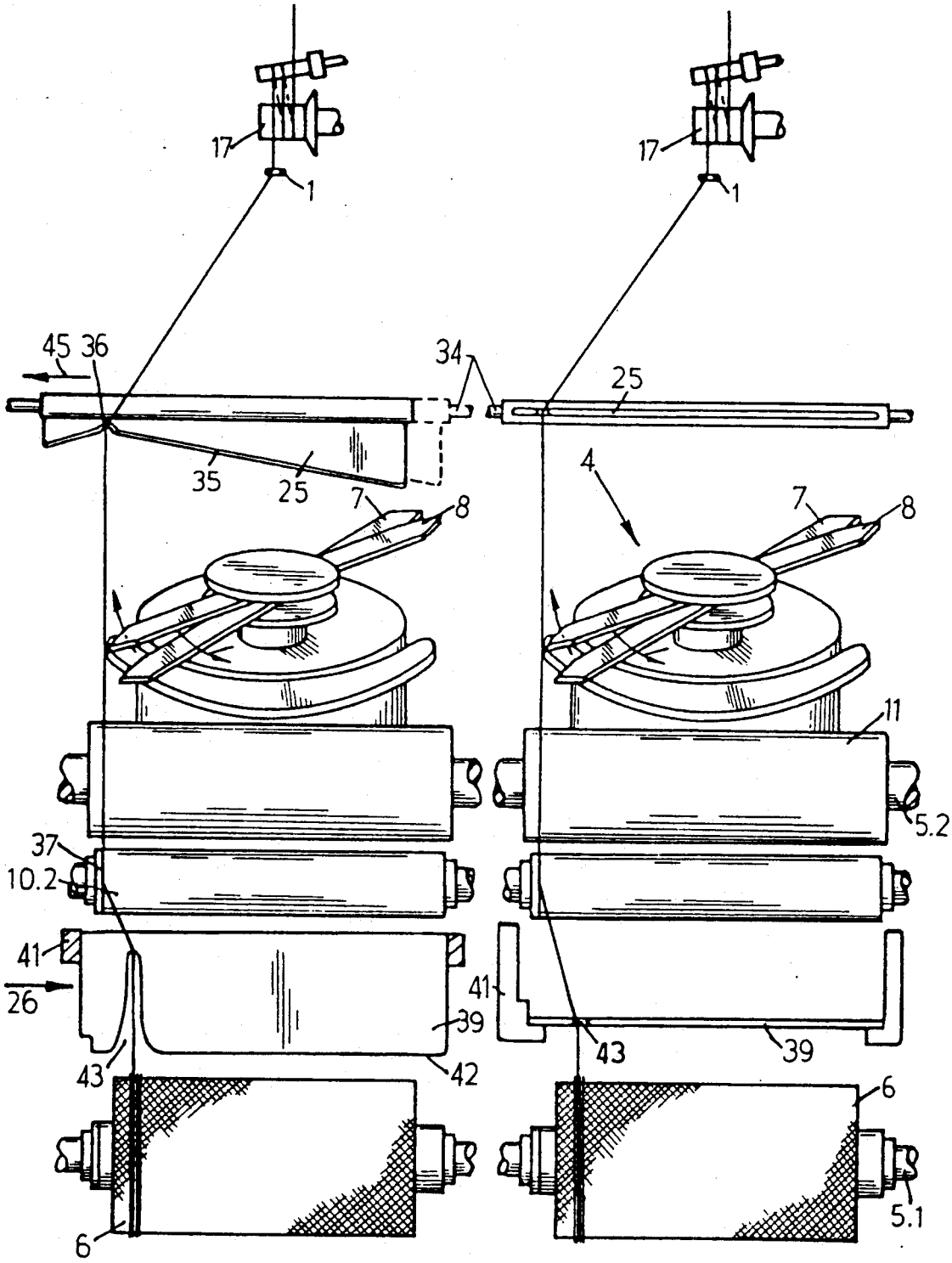
FIGS. 3A-3C are front elevation views illustrating the steps of the package doffing process of the present invention.

In order to automatically transfer the advancing yarn from the rotating full package to the rotating empty bobbin tube, the apparatus includes, in the illustrated embodiment, a yarn lifting device 25, which is shown rotated by 90° both in FIG. 2 and FIG. 3A, and which has an axis of rotation 34 which extends parallel to the direction of the yarn traverse, the axis of the contact roll and the axes of the winding spindles. Its V-shaped front edge 35 intersects with its two legs the axis of rotation 34, and forms in its moved-out position (FIG. 3B) two guide edges extending obliquely to the yarn traversing mechanism and converging at a guide notch 36. The guide notch 36 extends first in a plane which is normal to the winding spindle, and which lies within the traverse stroke. However, the yarn lifting device can be displaced along its axis of rotation 34 in direction of arrow 45 (FIGS. 2 and 3A), until the guide notch 36 lies in a normal plane, in which each of the winding tubes 10.1 and 10.2 has a yarn catching slot 37. In the present application, this normal plane is described as the catching plane. The catching slot is a narrow notch formed in the surface of the winding tube, which extends over a portion or the entire circumference and may have a special shape, which will be described in greater detail below. It also should be mentioned that the catching slot 37 is located outside of the traverse stroke H, over which the tube is normally wound.

Suitable embodiments of a catching slot 37 are shown in FIGS. 10 and 11, which will be described in greater detail hereinbelow. Another suitable embodiment of the yarn lifting device 25 will also be represented hereinbelow.

For the purpose of transferring the yarn, the yarn lifting device 25 is pivoted forwardly. By this pivotal motion of the yarn lifting device 25, the yarn is removed, as is shown in FIG. 4, from the contact zone of the rotary blades 7, 8 of the traversing mechanism 4 to such an extent that there exists no longer a contact. Consequently, the yarn slides along one of the oblique edges 35 and enters into the notch 36.

At the same time as the yarn lifting device is pivoted, a yarn transferring device 26 is also pivoted. The yarn transferring device comprises a rocking lever 41, the free end of which accommodates a deflecting device, which is a plate 39. The axis of rotation 38 extends in such a manner, and the length of the lever 41 and its shape are selected such that the plate 39 can be moved between the circumference of the empty spindle 5.2 moved to its operating position and the full package 6 moved to its doffing or standby position.

The shape of the plate 39 is shown in FIGS. 3A and 3B. It should be noted that a real front view thereof is shown in FIG. 3B. FIG. 3A differs therefrom only in that the yarn lifting device 25 and the yarn transferring device 26 are each shown rotated by 90° for a better illustration.

The plate 39 is moved from the side, on which the yarn advances, into the gap between the empty tube and the full package. As is shown in FIG. 3B, the front edge of the plate, i.e., that edge which contacts the yarn first when being pivoted, is constructed as a slide edge 42. A slot 43 which is perpendicular to the slide edge 42 is provided in the plate, and the slot is located in a normal plane which still intersects the full package 6, i.e., the traverse stroke H, but is located in an end zone close to the catching slot 37 provided in the tube. In the present application, this plane is referred to as the bead plane, since in this normal plane a yarn bead comprising a few windings is formed on the package so as to complete the latter.

Referring now to the situation when the yarn lifting device 25 is moved out and the yarn transferring device 26 is pivoted to the position shown respectively in FIG. 2 and FIG. 3B, the yarn first slides along the V-shaped edge 35, and, as a result thereof, along the slide edge 42 of the plate 39 at the same time. In so doing, the yarn enters into the notch 36 of the yarn lifting device 25 and into the retaining slot 43 of the yarn transferring device 26. It should here be emphasized that the guide notch 36 and the retaining slot 43 extend at first substantially in the same normal plane. Consequently, the yarn advances, at first without being reciprocated, in the winding zone of the empty tube 10.2, and in the winding zone of the full package 6, thereby forming a bead on the latter. Now, the yarn lifting device 25 is displaced toward the package end in which the catching slot is located, i.e. in the direction of arrow 45, until the guide notch 36 lies substantially in the normal plane in which the yarn slot 37 in the empty tube 10.2 is also located. While the yarn lifting device 25 performs this movement in the direction of arrow 45, the yarn is held in slot 43. On the other hand, the yarn is advanced by the notch 36 to the area of the catching slot in the empty tube 10.2, assisted by the contact roll 11, which is preferably driven during the yarn catching operation and, consequently, exerts a tension on the yarn. It should here be noted that the retaining slot 43 in the plate 39 has such a shape, and that the plate 39 enters into the gap between the full package and the empty tube so deeply that the yarn is also deflected in the sense of a larger looping of the empty tube 10.2.

The yarn thus advances to the catching slot 37 substantially in the normal plane of same. However, it leaves the catching slot at an acute angle, since it is deflected by the slot 43 in plate 39 in a direction toward the center of the traverse stroke. While FIGS. 3A-B show that the yarn leaves again the catching slot at an acute angle, they cannot show the spatial looping conditions, since the Figures illustrate a schematic, successive arrangement of the yarn traversing mechanism, the contact roll, the winding spindles, and the yarn transferring device. To this end, reference is made to FIG. 4. Due to the special shape of the catching slot and due to the large looping, the yarn first drops deeply into the catching slot. Since the yarn is guided out of the catching slot on the side, it is firmly clamped in the catching slot, so that it cannot leave the catching slot, and ruptures, if the denier of the yarn is low. If not so, a yarn cutter may be actuated at this moment, which cutter is attached on the plate 39 in the end zone of the retaining slot 43.

After the yarn is cut, the yarn end caught in the notch is now wound on the empty tube 10.2 of the winding spindle 5.2. Then, the yarn lifting device 25 returns to its inoperative position. Consequently, the yarn is again caught by the traversing mechanism 4 and reciprocated. As a result, the first layers of a package are formed on the empty tube. The gap between the package to be formed and the contact roll 11 remains for the time being. This means that the winding spindle 5.2 now in operation must be driven without a regulation of the circumferential speed of the forming package. Consequently, it is necessary to drive the winding spindle 5.2 at a constant speed, the speed being so predetermined that the circumferential speed of the empty tube and the first yarn layers has a value required for obtaining the yarn speed. However, during the time in which the contact roll does not rest against the forming package, the revolver 18 is also out of operation, i.e., the revolver 18 is stopped. The package is now doffed from the winding spindle 5.1 and the full package is replaced with an empty tube.

Figure 3C:
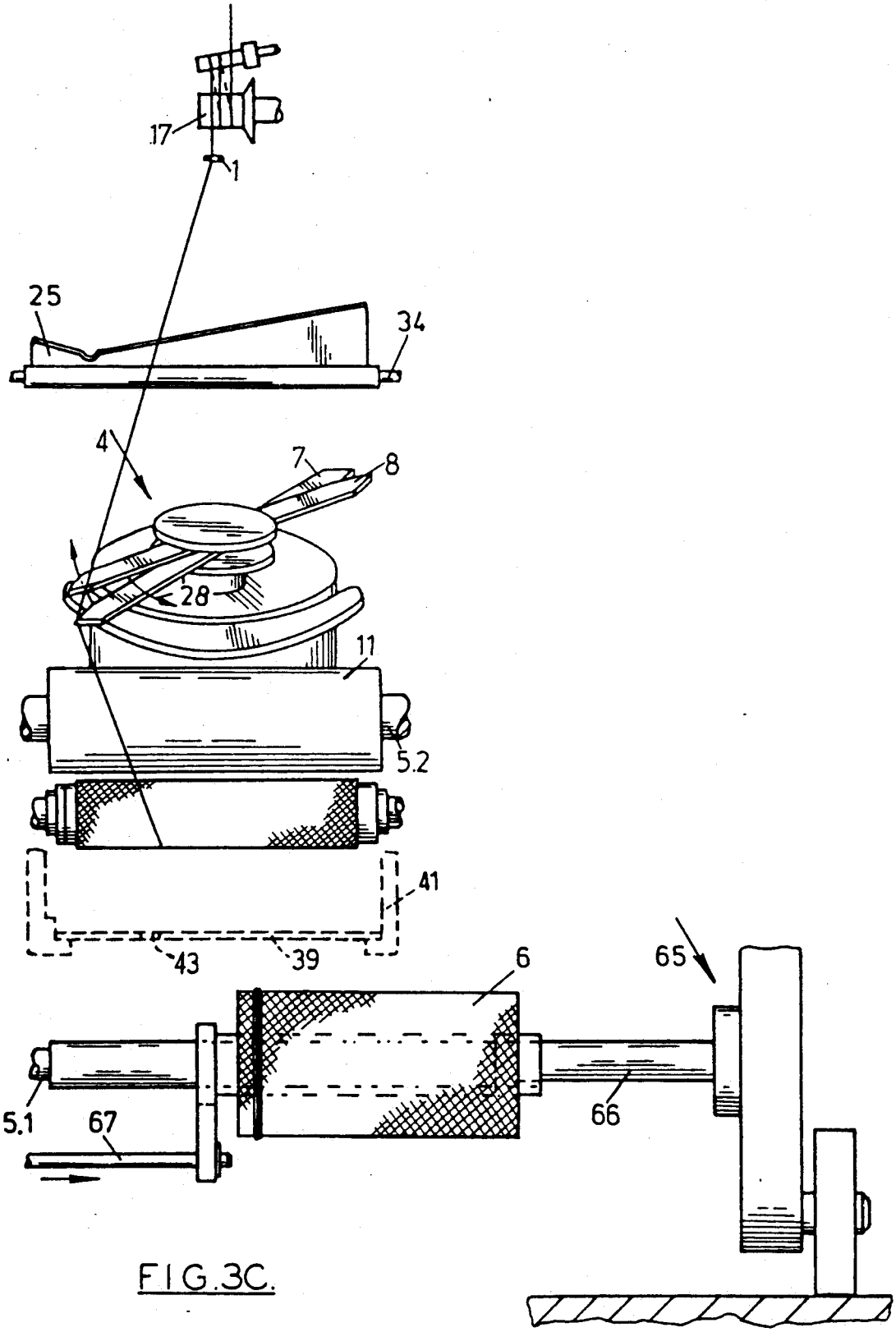

FIG. 3C is a partial view of a package transporting device 65 which serves as a doffer. This package transporting device 65 moves along the front of the winding machine, and it includes a spindle 66 which is aligned in height with the winding spindle 5.1 with the full package 6 formed thereon. During the doffing operation, the contact roll 11 is raised from the spindle 5.2 and from the new package to be formed which is at the start up position of the operating range B. A pushing device 67 is then actuated. Such a pushing device is described, for example, in German Patent 24 38 363 and corresponding U.S. Pat. No. 3,974,973, and it may for example comprise a fork which moves parallel to the winding spindle 5.1, thereby engaging with the bobbin tube 10.1 on the front surface on the machine side, and pushes same from the winding spindle 5.1 onto the spindle 66. In a corresponding manner, it is also possible to push empty tubes onto the winding spindle 5.2.

Other suitable doffers are disclosed, for example, in German Patent 24 49 415 and DE-OS 24 55 739. As aforesaid, this package doffing operation occurs while the contact roll is raised from the winding spindle 5.2 and the package forming thereon.

Two methods are possible to restart the rotational drive of the revolver 18. According to a first embodiment, the time which is necessary for the package doffing procedure is programmed in a controller and predetermined by the same. However, this time is not only predetermined so as to meet with the needs for the doffing procedure, but also in consideration of winding technological aspects, as further described below. After the predetermined time has elapsed, the controller restarts the rotational drive of the revolver in that the pressure in the pressure relief device 21 is again decreased to an amount as is desired in the normal operation. As a result, the contact roll lowers again until it rests on the package. The sensor 52 now functions again and controls the rotational drive of the revolver as a function of the monitored movements of the contact roll.

According to a second possible embodiments, as many yarn layers are wound on the empty tube 10.2 of the winding spindle 5.2 now in operation as are needed to make the developing package engage with the contact roll, thereby causing a deviation on the rocker arm 48, which is detected by the sensor 52. The output signal is now also used to reduce the pressure in the pressure relief device 21 to the amount desired for the normal operation.

As aforesaid, a first reason for raising the contact roll from the empty rube 10.2 and winding spindle 5.2 now in operation is to doff the package from the winding spindle 5.1 now at standby. However, a second reason relates to the winding technology. While the first yarn layers are wound, the package is very hard. Consequently, upon the contact of the contact roll with the first yarn layers the risk will be incurred that the yarn layers are damaged. This risk is avoided by the present invention, which considers this winding technological aspect when the time is predetermined during which the contact roll remains inoperative.

In addition, the present invention offers the possibility of predetermining the force at which the contact roll rests on the package, and of programming same during the winding cycle in such a manner as is desirable or necessary from the winding technological viewpoint. If a constant contact force is desired, the pressure relief device will be biased with a slight pressure during the winding operation after the contact between the contact roll and the forming package is made, which pressure remains constant and serves to compensate for a portion of the total weight of the rocker arm 48 and the contact roll as well as the traversing mechanism, so as to adjust the contact force which is exerted by the contact roll on the package, to the correct amount. However, as aforesaid, it is also possible to control the pressure in such a manner that a predetermined variation of the contact force is achieved during a winding cycle.

While the first yarn layers are wound, there exists the risk that the cut or torn yarn end on the full package 6, which still rotates and has not yet stopped, is flying free. An effective protection thereagainst is already offered by the plate 39. However, a protective plate 60 may be additionally provided, which is shown both in FIGS. 1 and 4. The protective plate 60 is pivotally supported, and its axis of rotation extends parallel to the axes of the winding spindles. During the operation, the plate is moved out of the possible range of movement of the revolver and the packages or winding spindles, and held in its idle position by a magnet 61. For the purpose of doffing a package and as is shown in FIG. 4, the protective plate 60 is pivoted toward the package revolver at the same time as the rocking arm 41 of the yarn transferring device 26 is pivoted. In so doing, the free end of the protective plate 60 supports itself against the free end of the plate 39. Since the protective plate 60 is moved on the side facing away from the yarn path, and since the plate 39 is pivoted from the side of the yarn path into the gap between the full package and the empty tube 10.2 at a time when the yarn is not yet torn or cut, both the plate 39 and the protective plate 60 offer a local and a complete, temporary protection of the new package to be wound on the empty tube 10.2 against the free flying yarn end of the full package. Naturally, the retaining slot 43 is designed very narrow, so that the flying yarn end of the full package cannot pass through the retaining slot.

FIGS. 10 and 11 and 10A and 11A, illustrate two embodiments of the yarn catching slot 37 on the bobbin tube 10. In FIGS. 10 and 10A, the tube 10 is provided with a yarn catching slot 37, which is located at a certain distance from its front end and extends in circumferential direction over an angle of, for example 120°. Assuming that both the surface of the tube 10 and the yarn move in the direction of arrow 55, the yarn catching slot starts with an entry portion 64. This entry portion 64 is characterized in that it has a relatively great width in comparison with the yarn diameter, and can extend over, for example, 45° of the package circumference. It is followed by a catching portion 65. The catching portion 65 is different in the two illustrated examples. In the embodiment of FIG. 10, the catching portion 65 is formed in that the catching slot tapers in the circumferential direction over a relatively short length of its circumference, for example 20°.

In the embodiment of FIG. 11, the catching portion 65 is so shaped that each wall obtains sawtoothlike projecting radial edges, which are successively arranged in the circumferential direction, for example, at a distance of 2 mm each. The edges of the opposite walls are displaced relative to each other and are, as aforesaid, sharp as a sawtooth. The axial spacing between the normal plane in which the edges are located, is smaller than the yarn thickness. The spacing may be zero or even negative. The edges are preferably directed in the direction of movement of the winding tube.

In operation, the yarn is guided for the purpose of catching in the normal plane of the catching slot 37. Since the yarn and the tube surface move in the same direction 55, the entry portion 64 contacts the yarn first, and the yarn drops substantially to the bottom the catching slot. This results in that the speed of the advancing yarn is slightly higher, on the order of 1%, than the translatory speed of the yarn catching slot or the tube respectively. However, the thus resultant relative speeds do not become effective in the form of frictional forces being operative on the yarn, since the entry portion 64 is so wide that it does not impede the yarn to any substantial extent. Consequently, the yarn tensions suffice to pull the yarn as deeply as possible into the catching slot or the entry portion thereof. The catching portion 65 is so shaped that clamping forces are exerted on the yarn very suddenly. This occurs in that the catching portion is very suddenly narrowed to such an extent that a positive engagement practically occurs between the yarn and the side walls of the catching slot. It should here be considered that the yarn is a synthetic multifilament yarn, which offers many contact possibilities for a positive engagement with respect to the winding tubes made of cardboard.

The very sudden, cutting edge-type narrowing of the catching portion 65 of FIG. 10 suffices to obtain this practical positive engagement. In the embodiment of the catching portion of FIG. 11, the yarn is very suddenly deflected in zigzag form, which leads to the desired positive engagement.

It has shown that the yarn, which enters deeply into the catching slot and is then clamped, is securely held and torn, especially when the yarn exits somewhat laterally from the catching slot as is provided by the device of the present invention.

In the drawings and specification, there has been set forth a preferred embodiment of the invention, and although specific terms are employed, they are used in a generic and descriptive sense only and not for purposes of limitation.

That which is claimed is:

1. An apparatus for continuously winding an advancing yarn onto bobbin tubes serially delivered to a winding position, and comprising a revolver rotatably mounting at least two spindles, with each spindle being adapted to mount at least one bobbin tube coaxially thereon, and such that each spindle and associated bobbin tube may be selectively moved between a winding position and a doffing position upon rotation of said revolver, means for winding an advancing yarn onto a bobbin tube at the winding position and including means for rotating the spindle and associated bobbin tube at the winding position, and traversing means mounted at a location upstream of the winding position for traversing an advancing yarn to form a cross wound package, a contact roll, and means mounting said contact roll at a location between said traversing means and the winding position and so as to be in circumferential contact with the package being wound, and with said mounting means permitting limited movement of said contact roll in a radial direction away from the package being wound at the winding position, sensor means for monitoring the radial movement of said contact roll and providing an output signal in response thereto, and rotary drive means for selectively rotating said revolver to move each spindle between said winding position and said doffing position, and for causing rotation of said revolver in response to said output signal from said sensor means so as to increase the distance between the axis of said contact roll and the axis of the spindle at said winding position as the package builds and so that the positioning of said contact roll remains within a predetermined range during the course of the winding operation.

2. The winding apparatus as defined in claim 1 wherein said rotary drive means acts to rotate said revolver in the same rotational direction as that of said spindles, and with said contact roll being positioned so that the advancing yarn loops about the contact roll by an angle of at least about 60 degrees in a first direction and then loops about the package being wound in the opposite direction.

3. The winding apparatus as defined in claim 2 wherein a contact plane is defined by the axis of said contact roll and the axis of said revolver, and the spindle at said winding position is located on the side of said contact plane toward which the yarn advancing from said contact roll is directed.

4. The winding apparatus as defined in claim 3 wherein an initial line of force (P1) is defined as a line between the axis of the contact roll and the axis of the spindle at the winding position at the beginning of the winding operation, and a spindle turning circle (S) is defined by the rotational movement of the axes of said spindles upon rotation of said revolver, and wherein said initial line of force forms a secant to said spindle turning circle.

5. The winding apparatus as defined in claim 4 wherein an extreme line of force (PE) is defined which extends from the axis of the contact roll and is tangent to said spindle turning circle, and wherein the angle between said initial line of force and said extreme line of force is less than about 20 degrees.

6. The winding apparatus as defined in claim 1 wherein said means mounting said contact roll permits the same to rest upon the surface of the package being wound with a gravitational force component, and said mounting means includes pressure control means for at least partially compensating for such gravitational force component.

7. The winding apparatus as defined in claim 6 wherein said pressure control means is controllable to maintain a predetermined force between the contact roll and the surface of the package being wound during the course of the winding operation.

8. The winding apparatus as defined in claim 6 wherein said pressure control means includes means for selectively lifting said contact roll from the surface of the bobbin tube on the spindle at said winding position at the beginning of the winding operation.

9. The winding apparatus as defined in claim 1 wherein said means mounting said contact roll includes a rocker arm, pivotal mounting means pivotally mounting one end of said rocker arm to the frame of said apparatus, and with said contact roll being mounted at the other free end of said rocker arm.

10. The winding apparatus as defined in claim 9 wherein said pivotal mounting means includes a shaft, a sleeve coaxially mounted about said shaft, and an elastic bushing interposed between said shaft and said sleeve.

11. The winding apparatus as defined in claim 9 wherein said traversing means comprises a traversing mechanism, and means mounting said traversing mechanism such that a substantial portion of the weight thereof is applied to said rocker arm.

12. The winding apparatus as defined in claim 11 wherein said pivotal mounting means of said rocker arm includes a shaft mounted to the frame of said apparatus, a sleeve fixed to said one end of said rocker arm and coaxially mounted upon said shaft, and wherein said means mounting said traversing mechanism includes a second rocker arm.

13. The winding apparatus as defined in claim 12 wherein said means mounting said traversing mechanism further includes spacing control means for maintaining a minimum spacing between said traversing mechanism and said contact roll.

14. The winding apparatus as defined in claim 12 wherein said second rocker arm is pivotally mounted to said shaft and so as to be independent of the pivotal movement of said first mentioned rocker arm about said shaft.

15. The winding apparatus as defined in claim 12 wherein said means mounting said traversing mechanism includes programmed control means by which the spacing between said traversing mechanism and said contact roll may be controlled through the entire course of the winding operation in accordance with a predetermined program.

16. The winding apparatus as defined in claim 1 further comprising means for automatically transferring the advancing yarn from the rotating full package which has been moved to the doffing position, to a rotating empty bobbin tube on a spindle which has been moved to the winding position, and comprising a deflecting yarn guide plate which is movable into the yarn path between the empty bobbin tube and the full package, said plate having a groove therein for engaging and holding the yarn against lateral movement outside the normal traverse stroke and so that the yarn is wound onto the full package in the form of a yarn bead and is looped about the rotating empty bobbin tube, and yarn guide means for removing the advancing yarn from the traversing means and conveying the advancing yarn laterally beyond the normal traverse stroke and so that the yarn is adapted to engage a yarn catching slot in the rotating empty bobbin tube.

17. The winding apparatus as defined in claim 16 further comprising a protective plate which is pivotally mounted to the frame of said apparatus and so as to be positioned on the side of rotating empty bobbin tube at the winding position which is opposite to the side which engages the advancing yarn, and such that the protective plate and said deflecting yarn guide plate are adapted to shield the empty bobbin tube from the rotating full package during the doffing procedure and prior the yarn being caught by said yarn catching slot in the empty bobbin tube.

18. The winding apparatus as defined in claim 1 wherein said rotary drive means includes means for positively rotating said revolver when said output signal from said sensor means indicates said contact roll is beyond said predetermined range of movement, and for braking the rotation of said revolver when said contact roll is not beyond said predetermined range of movement.

19. The winding apparatus as defined in claim 1 wherein said rotary drive means includes means for positively rotating said revolver substantially continuously during the entire winding operation and so as to maintain the movement of said contact roll within said predetermined range of movement.

20. An apparatus for continuously winding an advancing yarn onto bobbin tubes serially delivered to a winding position, and comprising a revolver rotatably mounting at least two spindles, with each spindle being adapted to mount at least one bobbin tube coaxially thereon, and such that each spindle and associated bobbin tube may be selectively moved between a winding position and a doffing position upon rotation of said revolver, means for winding an advancing yarn onto a bobbin tube at the winding position and including means for rotating the spindle and associated bobbin tube at the winding position, and traversing means including means mounting the traversing means at a location upstream of the winding position for traversing an advancing yarn to form a cross wound package;

a contact roll, and means mounting said contact roll at a location between said traversing means and the winding position, and said means mounting said traversing means permitting limited movement of said traversing means with respect to said contact roll and radially away from the package being wound at the winding position, and including programmed control means by which the spacing between said traversing mechanism and said contact roll may be controlled through the entire course of the winding operation in accordance with a predetermined program.

21. An apparatus as defined in claim 20, wherein said contact roll is positioned so as to be in circumferential contact with the package being wound.

22. An apparatus as defined in claim 20 wherein said contact roll is positioned so that the advancing yarn loops about the contact roll by an angle of at least about 60 degrees in a first direction and then loops about the package being wound in the opposite direction.

23. An apparatus for continuously winding an advancing yarn onto bobbin tubes serially delivered to a winding position, and comprising a revolver rotatably mounting at least two spindles, with each spindle being adapted to mount at least one bobbin tube coaxially thereon, and such that each spindle and associated bobbin tube may be selectively moved between a winding position and a doffing position upon rotation of said revolver, means for winding an advancing yarn onto a bobbin tube at the winding position and including means for rotating the spindle and associated bobbin tube at the winding position, and traversing means mounted at a location upstream of the winding position for traversing an advancing yarn to form a cross wound package, a contact roll, and means mounting said contact roll at a location between said traversing means and the winding position and so as to be in circumferential contact with the package being wound, rotary drive means for selectively rotating said revolver to move each spindle between said winding position and said doffing position, means for automatically transferring the advancing yarn from the rotating full package which has been moved to the doffing position, to a rotating empty bobbin tube on a spindle which has been moved to the winding position, and comprising a deflecting yarn guide plate which is movable into the yarn path between the empty bobbin tube and the full package, said plate having a groove therein for engaging and holding the yarn against lateral movement outside the normal traverse stroke and so that the yarn is wound onto the full package in the form of a yarn bead and is looped about the rotating empty bobbin tube, yarn guide means for removing the advancing yarn from the traversing means and conveying the advancing yarn laterally beyond the normal traverse stroke and so that the yarn is adapted to engage a yarn catching slot in the rotating empty bobbin tube, and a protective plate which is pivotally mounted to a frame of said apparatus and so as to be positioned on the side of rotating empty bobbin tube at the winding position which is opposite to the side which engages the advancing yarn, and such that the protective plate and said deflecting yarn guide plate are adapted to shield the empty bobbin tube from the rotating full package during the doffing procedure and prior the yarn being caught by said yarn catching slot in the empty bobbin tube.

24. A method for continuously winding a high speed advancing yarn onto bobbin tubes which are serially delivered to a winding position, and without yarn stoppage between bobbin tube changes, and wherein the first and second bobbin tubes are coaxially mounted on parallel spindles which are in turn mounted on a rotatable revolver, and comprising the steps of winding the advancing yarn onto a first bobbin tube positioned at the winding position, and including (a) traversing the yarn at a location upstream of the winding position to form a cross wound package on the bobbin tube, while (b) engaging the surface of the package being formed with a contact roll, with the contact roll being mounted for limited movement in a radial direction away from the package as the package builds, and (c) sensing the movement of the contact roll and rotating the revolver so as to laterally move the package being formed and thereby increase the radial distance between the package and the contact roll, and so as to maintain the positioning of the contact roll within a predetermined narrow range of movement during the course of the winding operation, continuing rotation of said revolver so as to laterally separate the rotating first bobbin tube from the winding position upon the first bobbin tube becoming full, moving an empty rotating second bobbin tube to the winding position, transferring the advancing yarn from the rotating full package to the rotating second bobbin tube and so that the yarn is wound thereupon, and repeating steps (a), (b), and (c) so as to form a cross wound package on the second bobbin tube.

25. The method as defined in claim 24 wherein the steps of continuing rotation of said revolver and moving an empty rotating second bobbin tube to the winding position include rotating the revolver about an axis which is parallel to and between the axes of the spindles, while rotating the spindles about their respective axes.

26. The method as defined in claim 25 including lifting the contact roll so as to be spaced a relatively short distance from the surface of the rotating second bobbin tube when the second bobbin tube is moved to the winding position, and maintaining the spaced relationship until after the yarn transferring step has been completed.

27. The method as defined in claim 26 wherein the step of moving an empty rotating second bobbin tube to the winding position includes moving the same so as to engage the advancing yarn as it advances toward the full package.

* * * * *